US006734138B2

(12) United States Patent
Suzuki et al.

(10) Patent No.: US 6,734,138 B2
(45) Date of Patent: May 11, 2004

(54) REVERSIBLE THERMOSENSITIVE RECORDING MATERIAL, AND IMAGE RECORDING AND ERASING METHOD USING THE RECORDING MATERIAL

(75) Inventors: Kazumi Suzuki, Suntoh-gun (JP); Toshihiko Hotta, Mishima (JP); Tetsuya Amano, Numazu (JP); Satoru Sanpei, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 39 days.

(21) Appl. No.: 09/996,935

(22) Filed: Nov. 30, 2001

(65) Prior Publication Data

US 2002/0107145 A1 Aug. 8, 2002

(30) Foreign Application Priority Data

Nov. 30, 2000 (JP) ..... 2000-365841

(51) Int. Cl.[7] ..... B41M 5/40
(52) U.S. Cl. ..... 503/201; 503/200; 503/226
(58) Field of Search ..... 503/201, 200, 503/226

(56) References Cited

U.S. PATENT DOCUMENTS

| | | | | |
|---|---|---|---|---|
| 5,087,601 A | * | 2/1992 | Hotta et al. | 503/200 |
| 5,716,477 A | | 2/1998 | Yamaguchi et al. | 156/230 |
| 5,747,413 A | | 5/1998 | Amano et al. | 503/201 |
| 5,880,445 A | | 3/1999 | Mori et al. | 503/201 |
| 5,916,841 A | | 6/1999 | Amano et al. | 503/200 |
| 5,920,844 A | | 7/1999 | Hotta et al. | 705/1 |
| 5,942,377 A | | 8/1999 | Torii et al. | 430/338 |
| 5,981,115 A | | 11/1999 | Furuya et al. | 430/19 |
| 5,981,429 A | | 11/1999 | Kawamura et al. | 503/207 |
| 6,090,748 A | | 7/2000 | Furuya et al. | 503/201 |
| 6,117,562 A | | 9/2000 | Yamaguchi et al. | 428/532 |
| 6,261,992 B1 | | 7/2001 | Furuya et al. | 503/201 |

FOREIGN PATENT DOCUMENTS

| | | |
|---|---|---|
| GB | 2 320 582 | 6/1998 |
| JP | 60-193691 | 10/1985 |
| JP | 61-237684 | 10/1986 |
| JP | 62-138556 | 6/1987 |
| JP | 62-138568 | 6/1987 |
| JP | 62-140881 | 6/1987 |
| JP | 63-173684 | 7/1988 |
| JP | 2-188293 | 7/1990 |
| JP | 2-188294 | 7/1990 |
| JP | 2-258287 | 10/1990 |
| JP | 5-124360 | 5/1993 |
| JP | 6-210954 | 8/1994 |
| JP | 8-156410 | 6/1996 |

* cited by examiner

*Primary Examiner*—B. Hamilton Hess
(74) *Attorney, Agent, or Firm*—Oblon, Spivak, McClelland, Maier & Neustadt, P.C.

(57) ABSTRACT

A reversible thermosensitive recording material including: a substrate; a recording layer located overlying the substrate and including a crosslinked resin, an electron donating coloring agent and an electron accepting coloring developer; and a protective layer located overlying the recording layer and including a filler and a crosslinked resin, wherein the recording layer achieves a colored state or a non-colored state when appropriately heating and cooling the recording layer, and wherein the reversible thermosensitive recording material has a surface having at least one of a ten-point mean roughness (Rz) not less than 1.5 $\mu$m or a ratio Sm/Rz not greater than 120, wherein Sm represents an average peak-to-peak length of the surface of the recording material.

23 Claims, 7 Drawing Sheets

REVERSIBLE THERMOSENSITIVE RECORDING MATERIAL, AND IMAGE RECORDING AND ERASING METHOD USING THE RECORDING MATERIAL

BACKGROUND OF THE INVENTION

1. Field of the Invention

The present invention relates to a reversible thermosensitive recording material, which reversibly changes its color when appropriately heated and then cooled. In addition, the present invention also relates to a method for recording and erasing an image in the reversible thermosensitive recording material.

2. Discussion of the Background

A variety of reversible thermosensitive recording materials have been proposed. For example, they are as follows:

(1) a recording material which includes a combination of gallic acid with phloroglucinol as a color developer (Japanese Laid-Open Patent Publication No. (hereinafter JOP) 60-193691);

(2) a recording material which includes phenolphthalein or Thymolphthalein as a color developer (JOP 61-237684);

(3) a recording material which includes an uniform solid solution of a coloring agent, a color developer and a carboxylic acid ester (JOPs 62-138556, 62-138568 and 62-140881);

(4) a recording material which includes an ascorbic acid derivative as a color developer (JOP 63-173684); and (5) a recording material which includes a higher aliphatic amine salt of bis (hydroxyphenyl) acetic acid or gallic acid as a color developer (JOPs 2-188293 and 2-188294).

JOP 5-124360 discloses a reversible thermosensitive coloring composition which includes a coloring agent such as a leuco dye and a color developer such as an organic phosphate compound, an aliphatic carboxylic acid compound or a phenolic compound each of which has a long-chain aliphatic hydrocarbon group, and a reversible thermosensitive recording material using the coloring composition. The reversible thermosensitive recording material can stably repeat image formation and erasure by being appropriately heated and cooled, and the image-recorded state and the image-erased state can be stably maintained at room temperature. In addition, JOP 6-210954 discloses a reversible thermosensitive recording material which includes a specific phenolic compound having a long-chain aliphatic hydrocarbon group as a color developer.

As mentioned above, various reversible thermosensitive recording materials capable of repeatedly performing color formation/erasure have been proposed. However, when image formation/erasure is repeatedly performed under practical image recording/erasing conditions, problems such that image qualities of the recorded image deteriorate and/or the recorded image has omissions tend to occur. Therefore a reversible thermosensitive recording material which can fully exhibit the color formation/erasure properties of its coloring composition including a color developer and a leuco dye has not yet been provided.

The reason for the deterioration of the image qualities is considered as follows. When an image is recorded in a recording material, the recording material is heated to a high temperature by a thermal printhead upon application of a mechanical force to the recording material. Therefore, the structure of the recording layer and protective layer tends to change and be damaged when repeatedly used. In order to prevent deterioration of image qualities, the mechanical durability of the recording material should be improved while the mechanical force applied to the recording material is decreased.

Image omissions are produced due to dust adhered to a thermal printhead. Such dust is formed on a thermal printhead, for example, when the thermal printhead touches a recording material on which one or more constituents of the recording material such as a color developer, which migrate from the inside of the recording material to the surface thereof, are deposited; a damaged portion or a peeled portion of the surface of the recording material; or when foreign particles adhered on the surface of the recording material are transferred to the thermal printhead. Therefore the image omission problem can be prevented by preventing adhesion of dust on the thermal printhead used.

Thus, in order that a reversible thermosensitive recording material is practically used in market, the recording material preferably has both a good head-matching property (i.e., a property such that the recording material does not stick to a thermal printhead (i.e., does not cause a feeding problem) and therefore does not receive excessive mechanical force), and a dust cleaning function such that the recording material cleans dust adhered to the thermal printhead used.

In addition, it is needed for a recording material to have a good visibility, i.e., an ability of exhibiting vivid color images. The color tone of recorded images is changed by light scattering on the surface of the recording material. When the color tone of an image deteriorates, contrast between the image with its background decreases, resulting in deterioration of image visibility of the recording material.

In attempting to solve such problems, JOP 08-156410 discloses a recording material in which a protective layer having specific gloss and surface roughness is formed on a recording layer to improve the head-matching property thereof. The recording material has an improved head-matching property but the color tone of recorded images deteriorates due to light scattering on the surface of the recording material. Therefore, the recording material has poor image visibility.

JOP 02-258287 discloses a transparent/opaque type reversible thermosensitive recording material in which a protective layer having a specific surface roughness is formed on a thermosensitive recording layer which records and erases an image by changing its transparency upon application of heat thereto to improve the dust-cleaning property of the recording material. This transparent/opaque type reversible thermosensitive recording material can record and erase an image at a relatively low heat energy. However, a coloring/non-coloring type reversible thermosensitive recording material needs a relatively high heat energy compared to the transparent/opaque type reversible thermosensitive recording material to record an image. Therefore the dust-cleaning property of the coloring/non-coloring type reversible thermosensitive recording material cannot be fully improved by this technique.

Because of these reasons, a need exists for a coloring/non-coloring type reversible thermosensitive recording material which has good image formation/erasure property and can repeatedly record/erase images having good visibility for a long period of time without causing the image-quality deterioration problem and the image omission problem.

SUMMARY OF THE INVENTION

Accordingly, an object of the present invention is to provide a coloring/non-coloring type reversible thermosensitive recording material has good image formation/erasure property and can repeatedly record/erase images having good visibility for a long period of time without causing the image-quality deterioration problem and the image omission problem.

Another object of the present invention is to provide a reversible thermal image formation/erasure method by which images having good visibility can be repeatedly formed and erased for a long period of time without causing the image-quality deterioration problem and the image omission problem.

Briefly these objects and other objects of the present invention as hereinafter will become more readily apparent can be attained by a reversible thermosensitive recording material having a substrate; and a recording layer located overlying the substrate, which includes a crosslinked resin, an electron donating coloring compound and an electron accepting compound, and a protective layer located overlying the recording layer and including a filler and a crosslinked resin, wherein the recording layer in a non-colored state achieves a colored state when heated at a temperature not lower than an image forming temperature and then cooled at a first cooling speed, and the recording layer in the colored state achieves a non-colored state when heated at a temperature lower than the image forming temperature and not lower than an image erasing temperature or when heated at a temperature not lower than the image forming temperature and then cooled at a second cooling speed relatively slow compared to the first cooling speed, and wherein the surface of the reversible thermosensitive recording material on the recording layer side has a ten-point mean roughness (Rz) not less than 1.5 $\mu$m, and preferably not greater than 3.5 $\mu$m.

Alternatively, the surface of the reversible thermosensitive recording material satisfies the following relationship:

$$Sm/Rz \leq 120$$

wherein Sm represents an average peak-to-peak length of the surface of the recording material, and Rz represents the ten-point mean roughness of the surface of the recording material. The ratio Sm/Rz is preferably not less than 30. Rz and Sm are determined by JIS B0610.

The surface of the recording material preferably has a film strength of grade F or harder, and more preferably grade H or harder when measured by JIS K5400-1990.

The recording material preferably has a structure in which a reversible thermosensitive recording layer, an intermediate layer and a protective layer are overlaid on a substrate in this order. Each of the recording layer, intermediate layer and protective layer includes a resin and preferably a crosslinked resin. In addition, at least one of the recording layer, intermediate layer and protective layer includes a filler, and preferably an inorganic filler.

The recording material may include an information recording portion such as magnetic recording media, IC memories, and optical memories. In addition, the side of the substrate opposite that bearing the recording layer may have an adhesive layer.

The recording material can be used as thermosensitive recording labels, point cards, prepaid cards, consultation tickets, admission tickets, commuter passes, etc., and used for discs, disc cartridges, cassette tapes, cassette cartridges, etc.

In another aspect of the present invention, a reversible thermal image recording and erasing method is provided which includes the steps of heating the recording layer of the reversible thermosensitive recording material of the present invention at a temperature lower than the image forming temperature and not lower than the image erasing temperature such that the recording layer maintains or achieves a non-colored state; and imagewise heating the previously heated recording layer in a non-colored state at a temperature not lower than the image forming temperature and then cooled rapidly to form an image in the recording layer. The heating is preferably performed by a thermal printhead.

In yet another aspect of the present invention, a reversible thermal image erasing (i.e., decoloring) method is provided which includes the step of heating the recording layer of the reversible thermosensitive recording material of the present invention at a temperature lower than the image forming temperature and not lower than the image erasing temperature such that the recording layer achieves a non-colored state. The heating is preferably performed by one of thermal printheads, ceramic heaters, heat rollers, hot stamps, and heat blocks.

In the present application, the term "erasing (or erasure)" means the decoloring of recording layers that are entirely colored, or partially colored and partially non-colored.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

As a result of the present inventors' investigation, it is found that the reversible thermosensitive recording material having such a specific surface roughness as mentioned above has both an improved matching property and a dust-cleaning function and can repeatedly record and erase an image for a long period of time without deteriorating the color tone and image visibility of the image.

Figure 1:
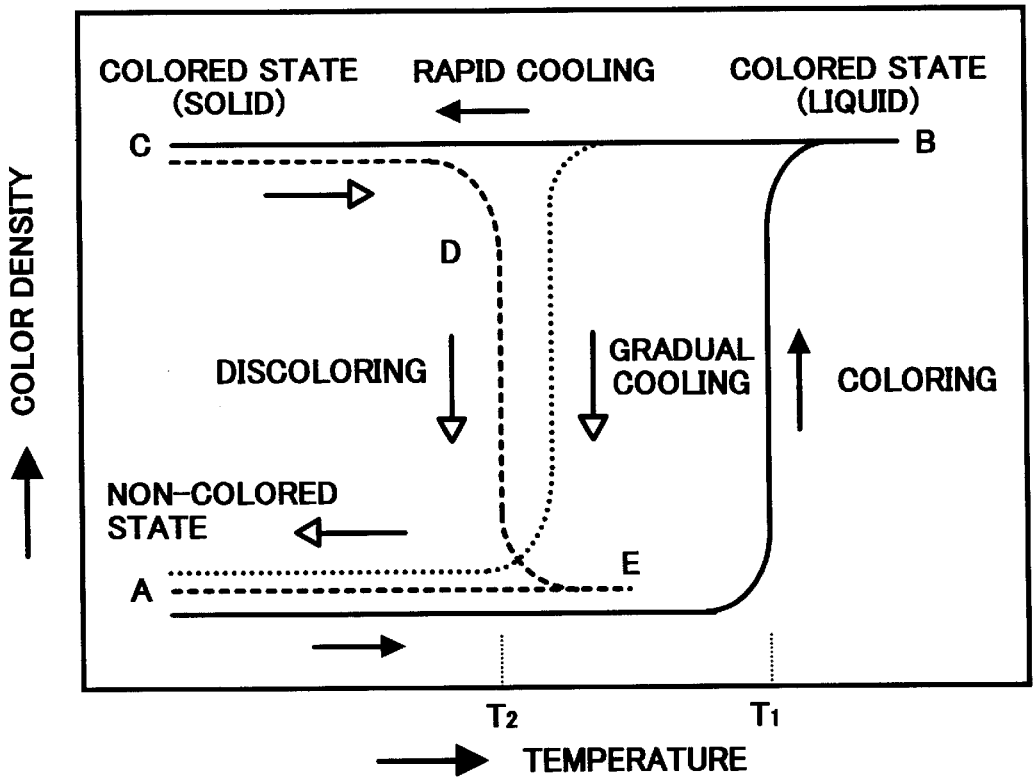
FIG. 1 is a schematic view illustrating the image forming/erasing properties of an embodiment of the reversible thermosensitive recording material of the present invention.

FIG. 1 is a graph illustrating the relationship between temperature of a reversible thermosensitive recording material (hereinafter referred to as a recording material) and image density thereof. When the recording material which is in a non-colored state A is heated, the recording material begins to color at an image forming temperature T1 at which at least one of an electron donating coloring agent and an electron accepting coloring developer is melted and then achieves a melted colored state B (a solid line A–B). If the recording material in the melted colored state B is rapidly cooled to room temperature, the recording material keeps the colored state and achieves a cooled colored state C in which the electron donating coloring agent and the electron accepting coloring developer are almost solidified. It depends upon cooling speed whether the recording material remains in the colored state, and if the recording material is gradually cooled, the recording material returns to the non-colored state A (a dotted line B–A) or achieves a semi-colored state in which the image density of the recording material is relatively low compared to the image density of the recording material in the cooled colored state C. If the recording material in the cooled colored state C is heated again, the recording material begins to discolor at an image erasing temperature T2 lower than T1 and achieves a non-colored state E (a broken line C–D–E). If the recording material in the non-colored state E is cooled to room temperature, the recording material returns to the non-colored state A. The temperatures T1 and T2 depend on the materials of the coloring agent and the coloring developer. Accordingly, by appropriately selecting a coloring agent and a coloring developer, a recording material having desired T1 and T2 can be obtained. The image densities of the recording material in the colored states B and C are not necessarily the same.

Within the context of the present invention, the term "relatively slow" as it relates to the difference between the second cooling speed and first cooling speed, means that the second cooling speed is sufficiently slow to permit the recording layer to return from the colored state to the non-colored state. This speed is slow relative to the first cooling speed, since the first cooling speed cools the recording layer quickly enough to retain the colored state.

In the colored state C, the recording layer includes the coloring agent and the coloring developer which form a solid in which a molecule of the coloring agent and a molecule of the coloring developer are mixed while contacting with each other.

In contrast, in the non-colored state at least one of the coloring agent and the coloring developer aggregates to form a domain, or crystallizes; thereby each phase of the coloring agent and the coloring developer is isolated from the other, and accordingly the recording material stably achieves the non-colored state. In the recording material of the present invention, the cohered structure of the coloring agent and the color developer is changed to a structure in which each of the phases of the coloring agent and the color developer is isolated from the other or the coloring developer crystallizes; thereby color erasure can be perfectly performed.

A colored image can be formed in the recording layer by heating the recording layer, for example by a thermal printhead, to a temperature not lower than an image forming temperature at which the coloring agent and color developer melt and mix with each other, and then cooling rapidly. The image can be erased by heating the recording layer to a temperature not lower than an image erasing temperature and lower than the image forming temperature or by heating the recording layer to a temperature not lower than the image forming temperature and then cooling gradually. These two erasing methods are based on the same mechanism in which the recording layer is temporarily kept at a temperature (i.e., a phase-separation temperature or crystallization temperature) in which the phase of the coloring agent separates from the phase of the color developer or at least one of the coloring agent and color developer crystallizes. The reason for the rapid cooling in the image forming process is that the recording layer is not kept at the phase-separation temperature or crystallization temperature.

At this point, the speed of the rapid cooling and gradually cooling changes depending on the combination of a coloring agent and a color developer.

The structure of the reversible thermosensitive recording material of the present invention will be explained.

Figure 2:
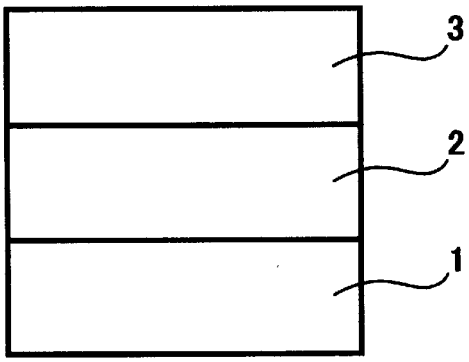
FIGS. 2 to 11 are schematic views illustrating the cross sections of embodiments of the reversible thermosensitive recording material of the present invention.

FIG. 2 is a schematic view illustrating the cross section of an embodiment of the reversible thermosensitive recording material of the present invention in which a recording layer 2 and a protective layer 3 are overlaid on one side of a substrate 1 in this order.

Figure 3:
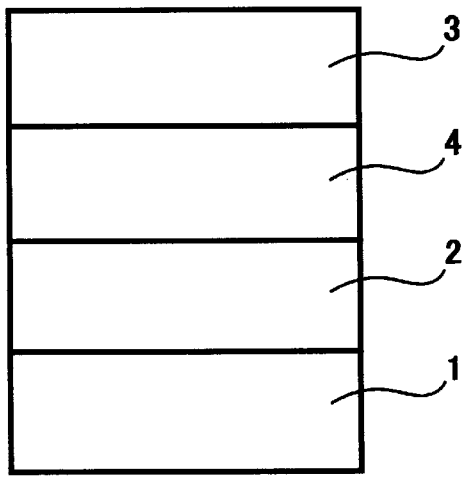

FIG. 3 is a schematic view illustrating the cross section of another embodiment of the reversible thermosensitive recording material of the present invention in which a recording layer 2, an intermediate layer 4 and a protective layer 3 are overlaid on one side of a substrate 1 in this order.

Figure 4:
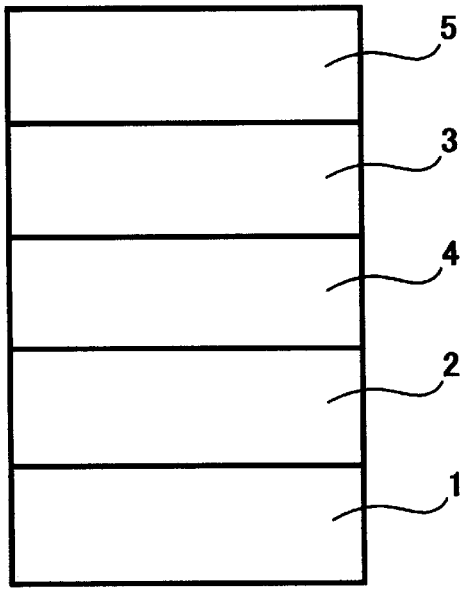

FIG. 4 is a schematic view illustrating the cross section of a yet another embodiment of the reversible thermosensitive recording material of the present invention in which a recording layer 2, an intermediate layer 4, a protective layer 3 and an OP layer 5 are overlaid on one side of a substrate 1 in this order.

Figure 5:
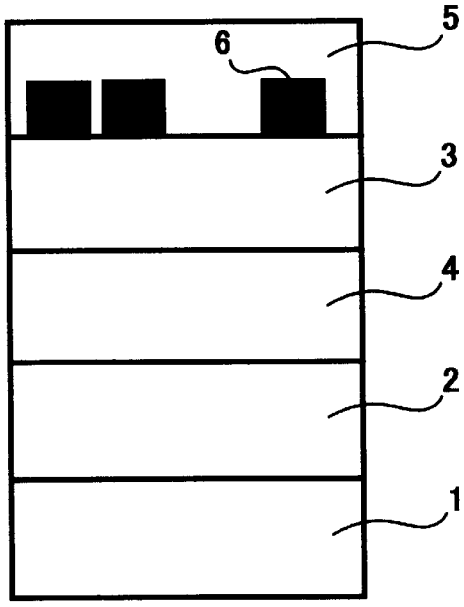

FIG. 5 is a schematic view illustrating the cross section of a further embodiment of the reversible thermosensitive recording material of the present invention in which a recording layer 2, an intermediate layer 4, and a protective layer 3 are overlaid on one side of a substrate 1 in this order. In addition, a print layer 6 is formed on a surface portion of the protective layer 3, and an OP layer (i.e., an over print layer) is overlaid on the protective layer 3 and print layer 6.

Figure 6:
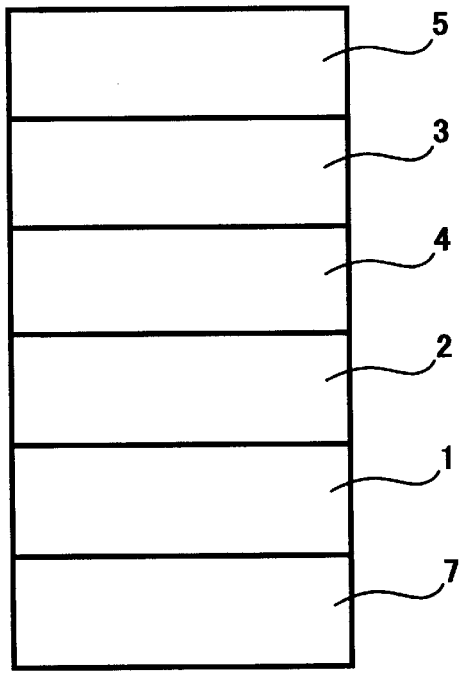

FIG. 6 is a schematic view illustrating the cross section of a still further embodiment of the reversible thermosensitive recording material of the present invention in which a magnetic recording layer 7 is formed on the back side of the substrate 1 of the recording material having a structure as shown in FIG. 4.

Figure 7:
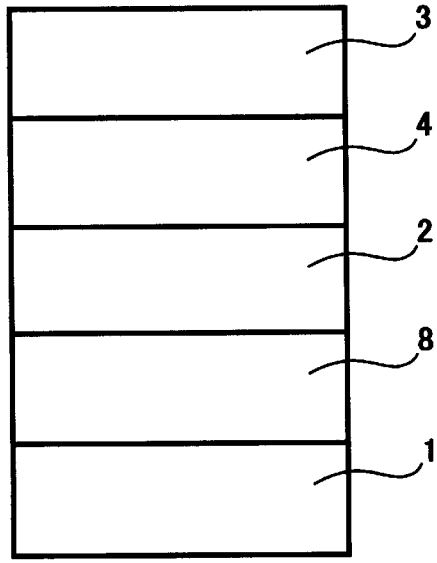

FIG. 7 is a schematic view illustrating the cross section of a still further embodiment of the reversible thermosensitive recording material of the present invention in which a colored layer 8, a recording layer 2, an intermediate layer 4 and a protective layer 3 are overlaid on one side of a substrate 1 in this order.

Figure 8:
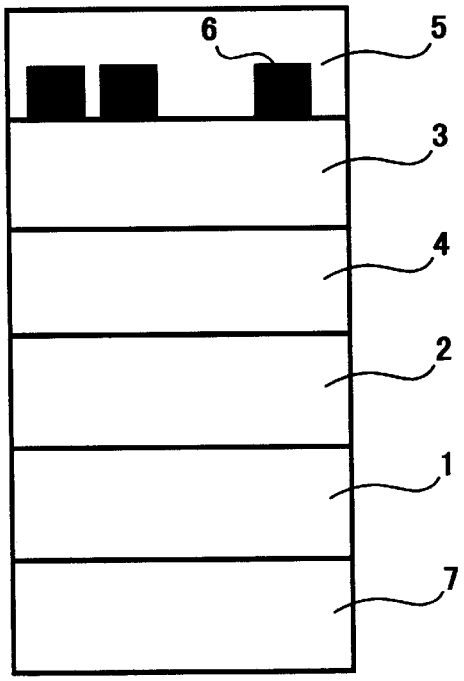

FIG. 8 is a schematic view illustrating the cross section of a still further embodiment of the reversible thermosensitive recording material of the present invention in which a magnetic recording layer 7 is formed on the back side of the substrate 1 of the recording material having a structure as shown in FIG. 5.

Figure 9:
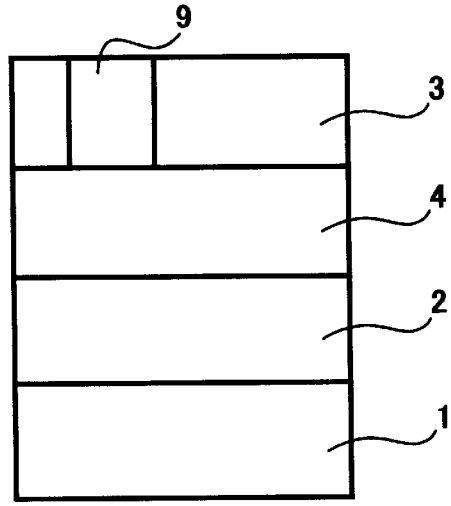

FIG. 9 is a schematic view illustrating the cross section of a still further embodiment of the reversible thermosensitive recording material of the present invention in which an information recording portion 9 is formed in a portion of the protective layer 3 of the recording material having a structure as shown in FIG. 3.

Figure 10:
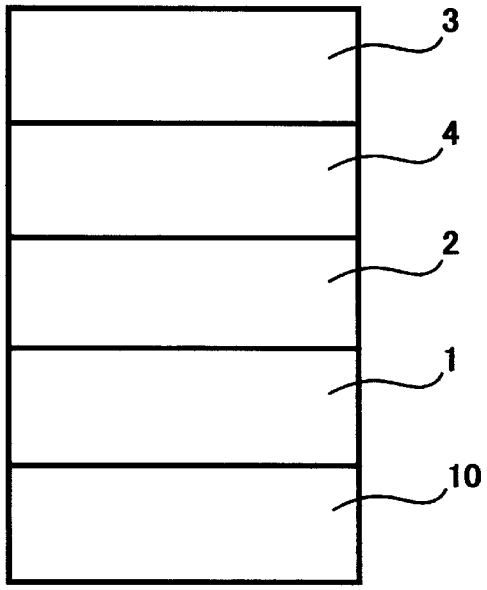

FIG. 10 is a schematic view illustrating the cross section of a still further embodiment of the reversible thermosensitive recording material of the present invention in which an adhesive layer 10 is formed on the backside of the substrate 1 of the recording material having a structure as shown in FIG. 3.

Figure 11:
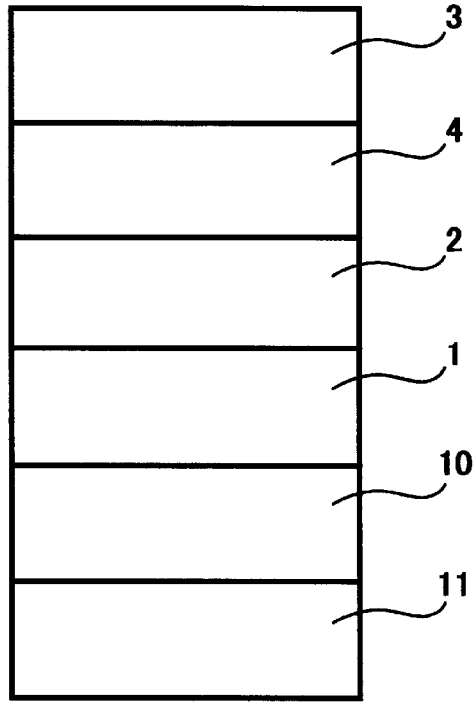

FIG. 11 is a schematic view illustrating the cross section of a still further embodiment of the reversible thermosensitive recording material of the present invention in which a second substrate 11 is formed on the adhesive layer 10 of the recording material having a structure as shown in FIG. 10.

The recording layer 2, intermediate layer 4 and protective layer 3 preferably include a crosslinked resin. Suitable crosslinked resins for use in these layers include known resins which have an active group which can react with a crosslinking agent upon application of heat. Specific examples of such heat-crosslinkable resins include resins having a hydroxide group and/or a carboxyl group, such as phenoxy resins, polyvinyl butyral resins, cellulose acetate propionate and cellulose acetate butyrate; copolymers of a monomer having hydroxyl group and/or a carboxyl group with another monomer, such as vinyl chloride resins, acrylic resins and styrene resins. Specific examples of such copolymers include vinyl chloride-vinyl acetate-vinyl alcohol copolymers, vinyl chloride-vinyl acetate-hydroxypropyl acrylate copolymers, vinyl chloride-vinyl acetate-maleic anhydride, etc.

Suitable crosslinking agents include isocyanate compounds, amino resins, phenolic resins, amines, epoxy resins, etc. Specific examples of such isocyanate compounds include hexamethylene diisocyanate (HDI), tolylene diisocyanate (TDI), xylylene diisocyanate (XDI), and adducts of these isocyanate compounds with trimethylol propane and the like, buret type compounds of these isocyanate compounds, isocyanurate type compounds of these isocyanate compounds and blocked isocyanate compounds of these isocyanate compounds.

As for the addition quantity of the crosslinking agents, the ratio of the number of active groups included in the resin to the number of functional groups included in the crosslinking agent is preferably from about 0.01 to about 2 to maintain good heat resistance and good image formation/erasure properties of the recording material.

In addition, the recording layer and the protective layer may include a crosslinking promoter, which is a catalyst useful for this kind of reaction, for example, tertiary amines such as 1,4-diaza-bicyclo(2,2,2)octane, and metal compounds such as organic tin compounds.

Crosslinking can be performed by application of an electron beam or ultraviolet light. Suitable monomers useful as a crosslinking agent for electron-beam crosslinking and ultraviolet-crosslinking include urethane-acrylate monomers, epoxy-acrylate monomers, polyester-acrylate monomers, polyether-acrylate monomers, vinyl monomers, unsaturated polyester oligomers, and mono- or polyfunctional monomers of acrylate, methacrylate, vinyl esters, ethylene derivatives, allyl compounds, etc.

Specific examples of such crosslinking agents include:

Monomers Having no Functional Group methyl methacrylate (MMA), ethyl methacrylate (EMA), n-butyl methacrylate (BMA), iso-butyl methacrylate (IBMA), t-butyl methacrylate (TBMA), 2-ethylhexyl methacrylate (EHMA), lauryl methacrylate (LMA), sec-lauryl methacrylate (SLMA), tridecyl methacrylate (TDMA), stearyl methacrylate (SMA), cyclohexyl methacrylate (LHMA) and benzyl methacrylate (BEMA).

Monomers Having One Functional Group methacrylic acid (MAA), 2-hydroxyethyl methacrylate (HEMA), 2-hydroxypropyl methacrylate (HPMA), dimethylaminoethyl methacrylate (DMMA), methyl chloride salts of dimethylaminoethyl methacrylate (DMCMA), diethylaminoethyl methacrylate (DEMA), glycidyl methacrylate (GMA), tetrahydrofurfuryl methacrylate (THFMA), allyl methacrylate (AMA), 2-ethoxyethyl methacrylate (ETMA), 2-ethylhexyl acrylate, phenoxyethyl acrylate, 2-ethoxyethyl acrylate, 2-ethoxyethoxyethyl acrylate, 2-hydroxyethyl acrylate, 2-hydroxypropyl acrylate, dicyclopentenylethyl acrylate, N-vinyl pyrrolidone and vinyl acetate.

Monomers Having Two Functional Groups 1,4-butanediol diacrylate, 1,6-hexanediol diacrylate, 1,9-nonanediol diacrylate, neopentyl glycol diacrylate, tetraethylene glycol diacrylate, tripropylene glycol diacrylate, polypropylene glycol diacrylate, ethylene glycol dimethacrylate (EDMA), triethylene glycol dimethacrylate (3EDMA), tetraethylene glycol dimethacrylate (4EDMA), 1,3-butylene glycol dimethacrylate (BDMA), 1,6-hexanediol dimethacrylate (HXMA), diacrylate esters of an adduct of bisphenol A with ethylene oxide, glycerin methacrylate acrylate, diacrylate esters of an adduct of neopentyl glycol with two moles of propylene oxide, diethylene glycol diacrylate, polyethylene glycol (400) diacrylate, diacrylate esters of an ester of hydroxy pivalate and neopentyl glycol, 2,2-bis(4-acryloyloxydiethoxyphenyl) propane, neopentyl glycol diadipate diacrylate, diacrylate esters of an adduct of neopentyl glycol hydroxypivalate with ϵ-caprolactone, 2-(2-hydroxy-1,1-dimethylethyl)-5-hydroxymethyl-5-ethyl-1,3-dioxane diacrylate, tricyclodecane dimethylol diacrylate, adducts of tricyclodecane dimethylol diacrylate with ϵ-caprolactone, and 1,6-hexanediol glycidyl ether diacrylate.

Monomers Having Three or More Functional Groups trimethylol propane trimethacrylate, trimethylol propane triacrylate, pentaerythritol triacrylate, acrylate esters of an adduct of glycerin with propylene oxide, trisacryloyloxyethyl phosphate, pentaerythritol tetraacrylate, triacrylate esters of an adduct of trimethylol propane with three moles of propylene oxide, glycerylpropoxy triacrylate, dipentaerythritol polyacrylate, polyacrylate esters of an adduct of dipentaerythritol with caprolactone, dipentaerythritol propionate triacrylate, triacrylate esters of hydroxypivalic aldehyde modified dimethylol propane, dipentaerythritol propionate tetraacrylate, ditrimethylol propane tetraacrylate, dipentaerythritol propionate pentaacrylate, dipentaerythritol hexaacrylate (DPHA) and adducts of dipentaerythritol hexaacrylate with ϵ-caprolactone.

Oligomers adducts of bisphenol A with diepoxy acrylic acid.

These crosslinking agents can be used alone or in combination. One or more of these crosslinking agents are included in a layer in an amount of from 5 to 50% by weight, and preferably from 10 to 40% by weight. When the addition amount is too small, the crosslinking effect is insufficient. To the contrary, when the addition amount is too large, the erasure property of the recording layer deteriorates. In order to improve crosslinking efficiency, monomers having one or more functional groups are used more preferably than monomers having no functional group. In addition, monomers having plural functional groups are used most preferably than monomers having one functional group.

When a resin is crosslinked using ultraviolet light, one or more of photopolymerization initiators are used. The photopolymerization initiators are broadly classified into radical reaction type initiators and hydrogen-extracting type initiators.

Specific examples of such photopolymerization initiators include the following, but are not limited thereto:

(1) benzoin ethers
  isobutyl benzoin ether, isopropyl benzoin ether, benzoin ethyl ether and benzoin methyl ether;

(2) α-acyloxime esters
  1-phenyl-1,2-propanedione-2-(o-ethoxycarbonyl) oxime;

(3) benzyl ketals
  2,2-dimethoxy-2-phenyl acetophenone and benzyl hydroxycyclohexylphenyl ketone;

(4) acetophenone derivatives
diethoxy acetophenone and 2-hydroxy-2-methyl-1-phenylpropane-1-one; and (5) ketones
benzophenone, 1-chlorothioxanthone, 2-chlorothioxanthone, isopropylthioxanthone, 2-methylthioxanthone and benzophenone substituted by a chlorine atom.

These photopolymerization initiators are used alone or in combination. The content of the photopolymerization initiator in a layer such as the recording layer and the protective layer is preferably from about 0.005 to about 1.0 part by weight, and more preferably from about 0.01 to about 0.5 part by weight, per 1 part by weight of the crosslinking agent included in the layer.

Photopolymerization promoters, which are used for hydrogen-extracting photopolymerization initiators such as benzophenone and thioxanthone compounds to improve the crosslinking speed, include aromatic tertiary amines, aliphatic amines, etc. Specific examples of such photopolymerization promoters include p-dimethylamino benzoic acid isoamyl ester, p-dimethylamino benzoic acid ethyl ester, etc.

These photopolymerization promoters can be used alone or in combination. The content of a photopolymerization promoter in a layer is preferably from 0.1 to 5 parts by weight, and more preferably from 0.3 to 3 parts by weight, per 1 part by weight of the photopolymerization initiator included in the layer.

Next, the color developer for use in the recording material, which is used in combination with a coloring agent, will be explained.

Suitable compounds for use as a color developer include compounds which have both a moiety capable of developing a coloring agent and a moiety capable of controlling cohesive force and which are disclosed in JOP 5-124360 in which organic phosphate compounds, carboxylic acid compounds and phenolic compounds each of which has a long chain hydrocarbon group are exemplified as a typical color developer.

Specific examples of the moiety capable of developing a coloring agent include acidic groups such as a phenolic hydroxyl group, a carboxyl group, a phosphate group, etc., but are not limited thereto. Any compounds having a group capable of developing a coloring agent can be used similarly to conventional thermosensitive recording materials. For example, compounds having a thiourea group or a carboxylic acid metal salt group can also be used.

Specific examples of the moiety capable of controlling cohesive force include hydrocarbon groups such as long chain hydrocarbons. The carbon number of such hydrocarbon groups is preferably not less than 8 to prepare a recording material having good color formation/erasure property. The hydrocarbon group may include an unsaturated bond. In addition, branched hydrocarbon groups are also included in the hydrocarbon group. It is preferable that the carbon number of the main chain of branched hydrocarbon groups is not less than 8. Further, the hydrocarbon group may be substituted with a group such as a halogen atom, a hydroxyl group and an alkoxyl group.

As mentioned above, the color developer for use in the recording material of the present invention has a structure in which a moiety capable of developing a coloring agent is connected with a moiety capable of controlling cohesive force. At the connecting portion of the moieties of these color developers, the below-mentioned divalent group having a hetero atom, divalent groups in which a plurality of such divalent groups having a hetero atom are combined may be included. In addition, the structures maybe connected with an aromatic group, such as a phenylene group and a naphthylene group, and/or a heterocyclic ring group, therebetween.

The hydrocarbon group may include one or more of the above-mentioned divalent groups, i.e., aromatic ring groups and divalent groups having a hetero atom.

Specific examples of the color developer for use in the recording material of the present invention include:

Organic Phosphate Compounds dodecyl phosphonate, tetradecyl phosphonate, hexadecyl phosphonate, octadecyl phosphonate, eicosyl phosphonate, docosyl phosphonate, tetracosyl phosphonate, ditetradecyl phosphate, dihexadecyl phosphate, dioctadecyl phosphate, dieicosyl phosphate and dibehenyl phosphate;

Aliphatic Carboxylic Acid Compounds 2-hydroxytetradecanoic acid, 2-hydroxyhexadecanoic acid, 2-hydroxyoctadecanoic acid, 2-hydroxyeicosanoic acid, 2-hydroxydocosanoic acid, 2-bromohexadecanoic acid, 2-bromooctadecanoic acid, 2-bromoeicosanoic acid, 2-bromodocosanoic acid, 3-bromooctadecanoic acid, 3-bromodocosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-iodooctadecanoic acid and perfluorooctadecanoic acid; and Aliphatic Dicarboxylic Acid Compounds and Aliphatic Tricarboxylic Acid Compounds 2-dodecyloxysuccinic acid, 2-tetradecyloxysuccinic acid, 2-hexadecyloxysuccinic acid, 2-octadecyloxysuccinic acid, 2-eicosyloxysuccinic acid, 2-docosyloxysuccinic acid, 2-dodecylthiosuccinic acid, 2-tetradecylthiosuccinic acid, 2-hexadecylthiosuccinic acid, 2-octadecylthiosuccinic acid, 2-eicosylthiosuccinic acid, 2-docosylthiosuccinic acid, 2-tetracosylthiosuccinic acid, 2-hexadecyldithiosuccinic acid, 2-octadecyldithiosuccinic acid, 2-eicosyldithiosuccinic acid, dodecylsuccinic acid, tetradecylsuccinic acid, pentadecylsuccinic acid, hexadecylsuccinic acid, octadecylsuccinic acid, eicosylsuccinic acid, docosylsuccinic acid, 2,3-dihexadecylsuccinic acid, 2,3-dioctadecylsuccinic acid, 2-methyl-3-hexadecylsuccinic acid, 2-methyl-3-octadecylsuccinic acid, 2-octadecyl-3-hexadecylsuccinic acid, hexadecylmalonic acid, octadecylmalonic acid, eicosylmalonic acid, docosylmalonic acid, dihexadecylmalonic acid, dioctadecylmalonic acid, didocosylmalonic acid, methyloctadecylmalonic acid, 2-hexadecylglutaric acid, 2-octadecylglutaric acid, 2-eicosylglutaric acid, docosylglutaric acid, 2-pentadecyladipic acid, 2-octadecyladipic acid, 2-eicosyladipic acid, 2-docosyladipic acid, 2-hexadecanoyloxypropane-1,2,3-tricarboxylic acid and 2-octadecanoyloxypropane-1,2,3-tricarboxylic acid.

Specific examples of carboxylic acids for use as the color developer include compounds having the following formula (1):

(1)

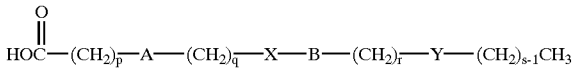

Specific examples of the carboxylic acids having formula (1) are illustrated in Tables 1 to 9 in which the number of p, q, r and s, and the structure of A, B, X and Y of each compound are shown.

TABLE 1

| p | A | q | X | B | r | Y | s |
|---|---|---|---|---|---|---|---|
| 0 | — (none) | 0 | CO | — | 0 | — | 12 |
| 0 | — | 0 | CO | — | 0 | — | 16 |
| 0 | — | 0 | CO | — | 0 | — | 18 |
| 1 | — | 0 | CO | — | 0 | — | 14 |
| 1 | — | 0 | CO | — | 0 | — | 18 |
| 1 | — | 0 | CO | — | 0 | — | 22 |
| 2 | — | 0 | CO | — | 0 | — | 16 |
| 1 | — | 0 | $SO_2$ | — | 0 | — | 14 |
| 2 | — | 0 | $SO_2$ | — | 0 | — | 18 |
| 2 | — | 0 | $SO_2$ | — | 0 | — | 20 |
| 4 | — | 0 | $SO_2$ | — | 0 | — | 18 |
| 5 | — | 0 | $SO_2$ | — | 0 | — | 11 |
| 6 | — | 0 | $SO_2$ | — | 0 | — | 18 |
| 3 | — | 0 | $SO_2$ | — | 4 | S | 12 |
| 2 | — | 0 | $SO_2$ | p-phenylene | 0 | S | 18 |
| 1 | — | 0 | $SO_2$ | — | 3 | $SO_2$ | 16 |
| 4 | — | 0 | $SO_2$ | — | 10 | CONH | 6 |
| 2 | — | 0 | $SO_2$ | p-phenylene | 0 | CONH | 18 |
| 3 | — | 0 | $SO_2$ | — | 3 | $SO_2NH$ | 16 |
| 1 | — | 0 | $SO_2$ | — | 6 | OCO | 10 |
| 4 | — | 0 | $SO_2$ | — | 10 | NHCO | 14 |
| 2 | — | 0 | $SO_2$ | — | 2 | $NHSO_2$ | 18 |
| 2 | — | 0 | $SO_2$ | — | 6 | NHCONH | 14 |
| 2 | — | 0 | $SO_2$ | p-phenylene | 0 | NHCONH | 18 |
| 2 | — | 0 | $SO_2$ | — | 3 | NHCOO | 16 |
| 2 | — | 0 | $SO_2$ | p-phenylene | 0 | OCONH | 18 |
| 4 | — | 0 | $SO_2$ | — | 2 | CONHCO | 16 |
| 2 | — | 0 | $SO_2$ | — | 12 | NHCONHCO | 8 |
| 3 | — | 0 | $SO_2$ | — | 6 | CONHNHCO | 16 |
| 4 | — | 0 | $SO_2$ | — | 4 | CONHCONH | 14 |
| 5 | — | 0 | $SO_2$ | — | 10 | NHCONHNH | 10 |
| 2 | — | 0 | $SO_2$ | — | 2 | NHNHCONH | 18 |
| 3 | — | 0 | $SO_2$ | — | 6 | NHCOCONH | 20 |
| 4 | — | 0 | $SO_2$ | — | 6 | NHCONHNHCO | 18 |
| 2 | — | 0 | $SO_2$ | p-phenylene | 8 | CONHNHCOO | 18 |
| 2 | — | 0 | $SO_2$ | — | 4 | CONHNHCONH | 18 |

TABLE 2

| p | A | q | X | B | r | Y | s |
|---|---|---|---|---|---|---|---|
| 2 | — | 0 | S | — | 0 | — | 20 |
| 1 | — | 0 | S | — | 0 | — | 14 |
| 2 | — | 0 | S | — | 0 | — | 16 |
| 2 | — | 0 | S | — | 0 | — | 18 |
| 3 | — | 0 | S | — | 0 | — | 22 |
| 3 | — | 0 | S | — | 4 | S | 12 |
| 2 | — | 0 | S | p-phenylene | 0 | S | 18 |
| 1 | — | 0 | S | — | 3 | $SO_2$ | 16 |
| 2 | — | 0 | S | — | 2 | CONH | 18 |
| 2 | — | 0 | S | p-phenylene | 0 | CONH | 18 |
| 3 | — | 0 | S | — | 3 | $SO_2NH$ | 16 |
| 2 | — | 0 | S | — | 1 | NHCO | 18 |
| 2 | — | 0 | S | — | 2 | $NHSO_2$ | 18 |
| 3 | — | 0 | S | — | 12 | NHCONH | 8 |
| 2 | — | 0 | S | p-phenylene | 0 | NHCONH | 18 |
| 2 | — | 0 | S | — | 3 | NHCOO | 16 |
| 2 | — | 0 | S | p-phenylene | 0 | OCONH | 18 |
| 4 | — | 0 | S | — | 2 | CONHCO | 16 |
| 2 | — | 0 | S | — | 4 | NHCONHNH | 18 |
| 3 | — | 0 | S | — | 6 | CONHNHCO | 16 |
| 4 | — | 0 | S | — | 4 | CONHCONH | 14 |
| 2 | — | 0 | S | — | 2 | NHNHCONH | 18 |
| 3 | — | 0 | S | — | 6 | NHCOCONH | 20 |
| 4 | — | 0 | S | — | 6 | NHCONHNHCO | 18 |
| 2 | — | 0 | S | — | 4 | CONHNHCONH | 18 |

TABLE 3

| p | A | q | X | B | r | Y | s |
|---|---|---|---|---|---|---|---|
| 2 | — | 0 | HNCO | — | 0 | — | 20 |
| 1 | — | 0 | HNCO | — | 0 | — | 12 |
| 2 | — | 0 | HNCO | — | 0 | — | 18 |
| 3 | — | 0 | HNCO | — | 0 | — | 22 |
| 4 | — | 0 | HNCO | — | 0 | — | 18 |
| 3 | — | 0 | HNCO | — | 4 | S | 12 |
| 2 | — | 0 | HNCO | p-phenylene | 0 | S | 18 |
| 1 | — | 0 | HNCO | — | 3 | $SO_2$ | 16 |
| 2 | — | 0 | HNCO | — | 2 | CONH | 18 |
| 3 | — | 0 | HNCO | — | 3 | $SO_2NH$ | 16 |
| 4 | — | 0 | HNCO | — | 3 | SCO | 16 |
| 4 | — | 0 | HNCO | — | 10 | NHCO | 14 |
| 4 | — | 0 | HNCO | — | 6 | N=CH | 16 |
| 2 | — | 0 | HNCO | — | 6 | NHCONH | 14 |
| 2 | — | 0 | HNCO | p-phenylene | 0 | NHCONH | 18 |
| 4 | — | 0 | HNCO | — | 4 | OCONH | 18 |
| 2 | — | 0 | HNCO | p-phenylene | 0 | OCONH | 18 |
| 3 | — | 0 | HNCO | — | 6 | NHCSO | 18 |
| 2 | — | 0 | HNCO | — | 12 | NHCONHCO | 8 |
| 3 | — | 0 | HNCO | — | 6 | CONHNHCO | 16 |
| 4 | — | 0 | HNCO | — | 4 | CONHCONH | 14 |
| 5 | — | 0 | HNCO | — | 10 | NHCONHNH | 10 |
| 3 | — | 0 | HNCO | — | 6 | NHCOCONH | 20 |
| 2 | — | 0 | HNCO | p-phenylene | 8 | CONHNHCOO | 18 |

TABLE 4

| p | A | q | X | B | r | Y | s |
|---|---|---|---|---|---|---|---|
| 1 | — | 0 | CONH | — | 0 | — | 12 |
| 2 | — | 0 | CONH | — | 0 | — | 16 |
| 2 | — | 0 | CONH | — | 0 | — | 18 |
| 3 | — | 0 | CONH | — | 0 | — | 22 |
| 5 | — | 0 | CONH | — | 0 | — | 11 |
| 2 | — | 0 | CONH | p-phenylene | 0 | S | 18 |
| 1 | — | 0 | CONH | — | 3 | $SO_2$ | 16 |
| 2 | — | 0 | CONH | — | 2 | CONH | 18 |
| 2 | — | 0 | CONH | p-phenylene | 0 | CONH | 18 |
| 4 | — | 0 | CONH | — | 3 | SCO | 16 |
| 1 | — | 0 | CONH | — | 6 | OCO | 10 |
| 4 | — | 0 | CONH | — | 10 | NHCO | 14 |
| 2 | — | 0 | CONH | — | 4 | COO | 22 |
| 2 | — | 0 | CONH | — | 2 | $NHSO_2$ | 18 |
| 3 | — | 0 | CONH | — | 12 | NHCONH | 8 |
| 2 | — | 0 | CONH | p-phenylene | 0 | NHCONH | 18 |
| 5 | — | 0 | CONH | — | 2 | NHSONH | 20 |
| 2 | — | 0 | CONH | — | 3 | NHCOO | 16 |
| 4 | — | 0 | CONH | — | 4 | OCONH | 18 |
| 2 | — | 0 | CONH | p-phenylene | 0 | OCONH | 18 |
| 3 | — | 0 | CONH | — | 6 | NHCSO | 18 |
| 4 | — | 0 | CONH | — | 2 | CONHCO | 16 |
| 2 | — | 0 | CONH | — | 12 | NHCONHCO | 8 |
| 3 | — | 0 | CONH | — | 6 | CONHNHCO | 16 |
| 4 | — | 0 | CONH | — | 4 | CONHCONH | 14 |
| 2 | — | 0 | CONH | — | 2 | NHNHCONH | 18 |
| 3 | — | 0 | CONH | — | 6 | NHCOCONH | 20 |
| 4 | — | 0 | CONH | — | 6 | NHCONHNHCO | 18 |
| 2 | — | 0 | CONH | p-phenylene | 8 | CONHNHCOO | 18 |

TABLE 5

| p | A | q | X | B | r | Y | s |
|---|---|---|---|---|---|---|---|
| 2 | — | 0 | NHCONH | — | 0 | — | 20 |
| 2 | — | 0 | NHCONH | — | 0 | — | 16 |
| 2 | — | 0 | NHCONH | — | 0 | — | 18 |
| 3 | — | 0 | NHCONH | — | 0 | — | 22 |
| 4 | — | 0 | NHCONH | — | 0 | — | 18 |
| 3 | — | 0 | NHCONH | — | 4 | S | 12 |
| 2 | — | 0 | NHCONH | p-phenylene | 0 | S | 18 |
| 1 | — | 0 | NHCONH | — | 3 | $SO_2$ | 16 |
| 4 | — | 0 | NHCONH | — | 10 | CONH | 6 |

TABLE 5-continued

| p | A | q | X | B | r | Y | s |
|---|---|---|---|---|---|---|---|
| 2 | — | 0 | NHCONH | p-phenylene | 0 | CONH | 18 |
| 3 | — | 0 | NHCONH | — | 3 | $SO_2NH$ | 16 |
| 4 | — | 0 | NHCONH | — | 3 | SCO | 16 |
| 4 | — | 0 | NHCONH | — | 10 | NHCO | 14 |
| 3 | — | 0 | NHCONH | — | 12 | COS | 6 |
| 2 | — | 0 | NHCONH | — | 4 | COO | 22 |
| 2 | — | 0 | NHCONH | — | 6 | NHCONH | 14 |
| 2 | — | 0 | NHCONH | p-phenylene | 0 | NHCONH | 18 |
| 5 | — | 0 | NHCONH | — | 2 | NHSONH | 20 |
| 2 | — | 0 | NHCONH | — | 3 | NHCOO | 16 |
| 2 | — | 0 | NHCONH | p-phenylene | 0 | OCONH | 18 |
| 1 | — | 0 | NHCONH | — | 3 | NHCOO | 14 |
| 3 | — | 0 | NHCONH | — | 6 | NHCSO | 18 |
| 2 | — | 0 | NHCONH | — | 12 | NHCONHCO | 8 |
| 2 | — | 0 | NHCONH | — | 4 | NHCONHNH | 18 |
| 3 | — | 0 | NHCONH | — | 6 | CONHNHCO | 16 |
| 4 | — | 0 | NHCONH | — | 4 | CONHCONH | 14 |
| 5 | — | 0 | NHCONH | — | 10 | NHCONHNH | 10 |
| 2 | — | 0 | NHCONH | — | 2 | NHNHCONH | 18 |
| 3 | — | 0 | NHCONH | — | 6 | NHCOCONH | 20 |
| 2 | — | 0 | NHCONH | — | 4 | CONHNHCONH | 18 |

TABLE 6

| p | A | q | X | B | r | Y | s |
|---|---|---|---|---|---|---|---|
| 1 | p-phenylene | 0 | NHCONH | — | 0 | — | 18 |
| 1 | p-phenylene | 0 | NHCONH | — | 0 | — | 22 |
| 2 | p-phenylene | 0 | NHCONH | — | 0 | — | 16 |
| 3 | p-phenylene | 0 | NHCONH | — | 0 | — | 18 |
| 1 | p-phenylene | 1 | NHCONH | — | 0 | — | 18 |
| 1 | p-phenylene | 2 | NHCONH | — | 0 | — | 16 |
| 2 | p-phenylene | 1 | NHCONH | — | 0 | — | 20 |
| 1 | p-phenylene | 0 | NHCONH | — | 6 | O | 16 |
| 1 | p-phenylene | 1 | NHCONH | — | 2 | O | 18 |
| 2 | p-phenylene | 0 | NHCONH | — | 8 | O | 14 |
| 2 | p-phenylene | 0 | NHCONH | p-phenylene | 0 | O | 18 |
| 1 | p-phenylene | 0 | NHCONH | p-phenylene | 0 | OCO | 20 |
| 1 | p-phenylene | 2 | NHCONH | p-phenylene | 0 | CO | 18 |
| 1 | p-phenylene | 0 | NHCONH | p-phenylene | 0 | S | 22 |
| 2 | p-phenylene | 0 | NHCONH | p-phenylene | 0 | NHCO | 16 |
| 1 | p-phenylene | 0 | NHCONH | p-phenylene | 0 | CONH | 18 |
| 1 | p-phenylene | 1 | NHCONH | p-phenylene | 0 | NHCONH | 18 |
| 1 | p-phenylene | 0 | NHCONH | p-phenylene | 0 | COO | 20 |
| 2 | p-phenylene | 0 | NHCONH | p-phenylene | 0 | $SO_2$ | 14 |
| 1 | p-phenylene | 0 | NHCO | — | 0 | — | 18 |
| 1 | p-phenylene | 0 | NHCO | — | 0 | — | 22 |
| 2 | p-phenylene | 0 | NHCO | — | 0 | — | 16 |
| 3 | p-phenylene | 0 | NHCO | — | 0 | — | 18 |
| 1 | p-phenylene | 1 | NHCO | — | 0 | — | 18 |
| 1 | p-phenylene | 2 | NHCO | — | 0 | — | 16 |
| 2 | p-phenylene | 1 | NHCO | — | 0 | — | 20 |
| 1 | p-phenylene | 0 | NHCO | — | 6 | O | 16 |
| 1 | p-phenylene | 1 | NHCO | — | 2 | O | 18 |
| 2 | p-phenylene | 0 | NHCO | — | 8 | O | 14 |
| 2 | p-phenylene | 0 | NHCO | p-phenylene | 0 | O | 18 |
| 1 | p-phenylene | 0 | NHCO | p-phenylene | 0 | OCO | 20 |
| 1 | p-phenylene | 2 | NHCO | p-phenylene | 0 | CO | 18 |
| 1 | p-phenylene | 0 | NHCO | p-phenylene | 0 | S | 22 |
| 2 | p-phenylene | 0 | NHCO | p-phenylene | 0 | NHCO | 16 |
| 1 | p-phenylene | 0 | NHCO | p-phenylene | 0 | CONH | 18 |
| 1 | p-phenylene | 1 | NHCO | p-phenylene | 0 | NHCONH | 18 |

TABLE 7

| p | A | q | X | B | r | Y | s |
|---|---|---|---|---|---|---|---|
| 1 | p-phenylene | 0 | NHCO | p-phenylene | 0 | COO | 20 |
| 2 | p-phenylene | 0 | NHCO | p-phenylene | 0 | $SO_2$ | 14 |
| 1 | p-phenylene | 0 | CONH | — | 0 | — | 18 |
| 1 | p-phenylene | 0 | CONH | — | 0 | — | 22 |
| 2 | p-phenylene | 0 | CONH | — | 0 | — | 16 |

TABLE 7-continued

| p | A | q | X | B | r | Y | s |
|---|---|---|---|---|---|---|---|
| 3 | p-phenylene | 0 | CONH | — | 0 | — | 18 |
| 1 | p-phenylene | 1 | CONH | — | 0 | — | 18 |
| 1 | p-phenylene | 2 | CONH | — | 0 | — | 16 |
| 2 | p-phenylene | 1 | CONH | — | 0 | — | 20 |
| 1 | p-phenylene | 0 | CONH | — | 6 | O | 16 |
| 1 | p-phenylene | 1 | CONH | — | 2 | O | 18 |
| 2 | p-phenylene | 0 | CONH | — | 8 | O | 14 |
| 2 | p-phenylene | 0 | CONH | p-phenylene | 0 | O | 18 |
| 1 | p-phenylene | 0 | CONH | p-phenylene | 0 | OCO | 20 |
| 1 | p-phenylene | 2 | CONH | p-phenylene | 0 | CO | 18 |
| 1 | p-phenylene | 0 | CONH | p-phenylene | 0 | S | 22 |
| 2 | p-phenylene | 0 | CONH | p-phenylene | 0 | NHCO | 16 |
| 1 | p-phenylene | 0 | CONH | p-phenylene | 0 | CONH | 18 |
| 1 | p-phenylene | 1 | CONH | p-phenylene | 0 | NHCONH | 18 |
| 1 | p-phenylene | 0 | CONH | p-phenylene | 0 | COO | 20 |
| 2 | p-phenylene | 0 | CONH | p-phenylene | 0 | $SO_2$ | 14 |
| 1 | p-phenylene | 0 | OCONH | — | 0 | — | 18 |
| 2 | p-phenylene | 0 | OCONH | — | 0 | — | 16 |
| 3 | p-phenylene | 0 | OCONH | — | 0 | — | 18 |
| 1 | p-phenylene | 1 | OCONH | — | 0 | — | 18 |
| 1 | p-phenylene | 2 | OCONH | — | 0 | — | 16 |
| 2 | p-phenylene | 1 | OCONH | — | 0 | — | 20 |
| 1 | p-phenylene | 0 | OCONH | — | 6 | O | 16 |
| 1 | p-phenylene | 1 | OCONH | — | 2 | O | 18 |
| 2 | p-phenylene | 0 | OCONH | — | 8 | O | 14 |
| 2 | p-phenylene | 0 | OCONH | p-phenylene | 0 | O | 18 |
| 1 | p-phenylene | 0 | OCONH | p-phenylene | 0 | OCO | 20 |
| 1 | p-phenylene | 2 | OCONH | p-phenylene | 0 | CO | 18 |
| 1 | p-phenylene | 0 | OCONH | p-phenylene | 0 | S | 22 |
| 2 | p-phenylene | 0 | OCONH | p-phenylene | 0 | NHCO | 16 |
| 1 | p-phenylene | 0 | OCONH | p-phenylene | 0 | CONH | 18 |

TABLE 8

| p | A | q | X | B | r | Y | s |
|---|---|---|---|---|---|---|---|
| 1 | p-phenylene | 1 | OCONH | p-phenylene | 0 | NHCONH | 18 |
| 1 | p-phenylene | 0 | OCONH | p-phenylene | 0 | COO | 20 |
| 2 | p-phenylene | 0 | OCONH | p-phenylene | 0 | $SO_2$ | 14 |
| 1 | p-phenylene | 0 | COO | — | 0 | — | 18 |
| 2 | p-phenylene | 0 | OCO | — | 0 | — | 16 |
| 3 | p-phenylene | 0 | COO | — | 0 | — | 18 |
| 1 | p-phenylene | 1 | OCO | — | 0 | — | 18 |
| 1 | p-phenylene | 2 | COO | — | 0 | — | 16 |
| 2 | p-phenylene | 1 | OCO | — | 0 | — | 20 |
| 1 | p-phenylene | 0 | COO | — | 6 | O | 16 |
| 1 | p-phenylene | 1 | OCO | — | 2 | O | 18 |
| 2 | p-phenylene | 0 | COO | — | 8 | O | 14 |
| 2 | p-phenylene | 0 | OCO | p-phenylene | 0 | O | 18 |
| 1 | p-phenylene | 0 | OCO | p-phenylene | 0 | OCO | 20 |
| 1 | p-phenylene | 2 | COO | p-phenylene | 0 | CO | 18 |
| 1 | p-phenylene | 0 | OCO | p-phenylene | 0 | S | 22 |
| 2 | p-phenylene | 0 | COO | p-phenylene | 0 | NHCO | 16 |
| 1 | p-phenylene | 0 | COO | p-phenylene | 0 | CONH | 18 |
| 1 | p-phenylene | 1 | OCO | p-phenylene | 0 | NHCONH | 18 |
| 1 | p-phenylene | 0 | COO | p-phenylene | 0 | COO | 20 |
| 2 | p-phenylene | 0 | OCO | p-phenylene | 0 | $SO_2$ | 14 |
| 1 | p-phenylene | 0 | O | — | 0 | — | 14 |
| 1 | p-phenylene | 0 | S | — | 0 | — | 18 |
| 1 | p-phenylene | 0 | $SO_2$ | — | 0 | — | 22 |
| 2 | p-phenylene | 0 | O | — | 0 | — | 16 |
| 3 | p-phenylene | 0 | S | — | 0 | — | 18 |
| 1 | p-phenylene | 1 | $SO_2$ | — | 0 | — | 18 |
| 1 | p-phenylene | 2 | O | — | 0 | — | 16 |
| 2 | p-phenylene | 1 | S | — | 0 | — | 20 |
| 1 | p-phenylene | 0 | $SO_2$ | — | 6 | O | 16 |
| 1 | p-phenylene | 1 | O | — | 2 | O | 18 |
| 2 | p-phenylene | 0 | S | — | 8 | O | 14 |
| 2 | p-phenylene | 0 | $SO_2$ | p-phenylene | 0 | O | 18 |
| 1 | p-phenylene | 0 | O | p-phenylene | 0 | OCO | 20 |
| 1 | p-phenylene | 2 | S | p-phenylene | 0 | CO | 18 |
| 1 | p-phenylene | 0 | $SO_2$ | p-phenylene | 0 | S | 22 |

TABLE 9

| p | A | q | X | B | r | Y | s |
|---|---|---|---|---|---|---|---|
| 2 | p-phenylene | 0 | O | p-phenylene | 0 | NHCO | 16 |
| 1 | p-phenylene | 0 | S | p-phenylene | 0 | CONH | 18 |
| 1 | p-phenylene | 1 | O | p-phenylene | 0 | NHCONH | 18 |
| 1 | p-phenylene | 0 | $SO_2$ | p-phenylene | 0 | COO | 20 |
| 2 | p-phenylene | 0 | $SO_2$ | p-phenylene | 0 | $SO_2$ | 14 |

Suitable carboxylic acid compound for use as the color developer include compounds having the following formula (2):

(2)

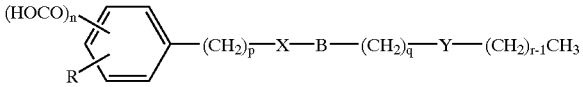

Specific examples of the carboxylic acid compounds having formula (2) include the compounds as shown in Tables 10 to 13 in which the number of n, p, q and r, and the structure of R, X, B and Y are shown.

TABLE 10

| n | R | P | X | B | q | Y | r |
|---|---|---|---|---|---|---|---|
| 1 (4-) | — | 0 | NHCONH | — | 0 | — | 18 |
| 1 (4-) | — | 1 | NHCONH | — | 0 | — | 20 |
| 2 (3-, 5-) | — | 0 | NHCONH | — | 0 | — | 14 |
| 2 (4-) | (3-OH) | 0 | NHCONH | — | 0 | — | 18 |
| 1 (4-) | (2-$CH_3$) | 0 | NHCONH | — | 0 | — | 16 |
| 1 (4-) | (3-Cl) | 2 | NHCONH | — | 0 | — | 18 |
| 1 (3-) | (4-OH) | 0 | NHCONH | — | 0 | — | 22 |
| 1 (4-) | (3-OH) | 0 | NHCONH | — | 6 | O | 14 |
| 1 (4-) | (3-OH) | 1 | NHCONH | p-phenylene | 0 | O | 18 |
| 1 (4-) | (3-Cl) | 0 | NHCONH | p-phenylene | 0 | S | 16 |
| 1 (3-) | (4-OH) | 0 | NHCONH | p-phenylene | 0 | NHCO | 18 |
| 1 (3-) | (4-OH) | 0 | NHCONH | p-phenylene | 0 | CONH | 20 |
| 1 (4-) | (3-OH) | 0 | NHCONH | p-phenylene | 0 | NHCONH | 18 |
| 1 (4-) | (3-$OCH_3$) | 1 | NHCONH | p-phenylene | 0 | OCO | 14 |
| 1 (4-) | (3-OH) | 0 | NHCONH | p-phenylene | 0 | COO | 18 |
| 1 (4-) | (3-Cl) | 0 | NHCONH | p-phenylene | 0 | $SO_2$ | 18 |
| 1 (4-) | (3-OH) | 0 | NHCONH | p-phenylene | 0 | $SO_2NH$ | 18 |
| 1 (4-) | — | 0 | NHCO | — | 0 | — | 18 |
| 1 (4-) | — | 2 | NHCO | — | 0 | — | 20 |
| 2 (3-, 4-) | — | 0 | NHCO | — | 0 | — | 14 |
| 2 (4-) | (3-OH) | 0 | NHCO | — | 0 | — | 18 |
| 1 (4-) | (2-$CH_3$) | 0 | NHCO | — | 0 | — | 16 |
| 1 (4-) | (3-Cl) | 2 | NHCO | — | 0 | — | 18 |
| 1 (3-) | (4-OH) | 0 | NHCO | — | 0 | — | 22 |
| 1 (4-) | (3-OH) | 0 | NHCO | — | 6 | O | 14 |
| 1 (4-) | (3-OH) | 1 | NHCO | p-phenylene | 0 | O | 18 |
| 1 (4-) | (3-Cl) | 0 | NHCO | p-phenylene | 0 | CO | 16 |
| 1 (3-) | (4-OH) | 0 | NHCO | p-phenylene | 0 | NHCO | 18 |
| 1 (3-) | (4-OH) | 0 | NHCO | p-phenylene | 0 | CONH | 20 |
| 1 (4-) | (3-OH) | 0 | NHCO | p-phenylene | 0 | NHCONH | 18 |
| 1 (4-) | (3-$OCH_3$) | 1 | NHCO | p-phenylene | 0 | OCO | 14 |
| 1 (4-) | (3-OH) | 0 | NHCO | p-phenylene | 0 | COO | 18 |
| 1 (4-) | (3-Cl) | 0 | NHCO | p-phenylene | 0 | $SO_2$ | 18 |
| 1 (4-) | (3-OH) | 0 | NHCO | p-phenylene | 0 | $SO_2NH$ | 18 |
| 1 (4-) | — | 0 | CONH | — | 0 | — | 18 |
| 1 (4-) | — | 1 | CONH | — | 0 | — | 20 |

TABLE 11

| n | R | P | X | B | q | Y | r |
|---|---|---|---|---|---|---|---|
| 2 (3-, 5-) | — | 0 | CONH | — | 0 | — | 14 |
| 2 (4-) | (3-OH) | 0 | CONH | — | 0 | — | 18 |
| 1 (4-) | (2-$CH_3$) | 0 | CONH | — | 0 | — | 16 |
| 1 (4-) | (3-Cl) | 2 | CONH | — | 0 | — | 18 |
| 1 (3-) | (4-OH) | 0 | CONH | — | 0 | — | 22 |
| 1 (4-) | (3-OH) | 0 | CONH | — | 6 | O | 14 |
| 1 (4-) | (3-OH) | 1 | CONH | p-phenylene | 0 | O | 18 |
| 1 (4-) | (3-Cl) | 0 | CONH | p-phenylene | 0 | S | 16 |
| 1 (3-) | (4-OH) | 0 | CONH | p-phenylene | 0 | NHCO | 18 |
| 1 (3-) | (4-OH) | 0 | CONH | p-phenylene | 0 | CONH | 20 |
| 1 (4-) | (3-OH) | 0 | CONH | p-phenylene | 0 | NHCONH | 18 |
| 1 (4-) | (3-$OCH_3$) | 1 | CONH | p-phenylene | 0 | OCO | 14 |
| 1 (4-) | (3-OH) | 0 | CONH | p-phenylene | 0 | COO | 18 |
| 1 (4-) | (3-Cl) | 0 | CONH | p-phenylene | 0 | $SO_2$ | 18 |
| 1 (4-) | (3-OH) | 0 | CONH | p-phenylene | 0 | $SO_2NH$ | 18 |
| 1 (4-) | — | 0 | OCONH | — | 0 | — | 18 |
| 1 (4-) | — | 2 | NHCOO | — | 0 | — | 20 |
| 2 (3-, 5-) | — | 0 | OCONH | — | 0 | — | 14 |
| 2 (4-) | (3-OH) | 0 | NHCOO | — | 0 | — | 18 |
| 1 (4-) | (2-$CH_3$) | 0 | OCONH | — | 0 | — | 16 |
| 1 (4-) | (3-Cl) | 2 | NHCOO | — | 0 | — | 18 |
| 1 (3-) | (4-OH) | 0 | OCONH | — | 0 | — | 22 |
| 1 (4-) | (3-OH) | 0 | NHCOO | — | 6 | O | 14 |
| 1 (4-) | (3-OH) | 1 | OCONH | p-phenylene | 0 | O | 18 |
| 1 (4-) | (3-Cl) | 0 | NHCOO | p-phenylene | 0 | CO | 16 |
| 1 (3-) | (4-OH) | 0 | OCONH | p-phenylene | 0 | NHCO | 18 |
| 1 (3-) | (4-OH) | 0 | NHCOO | p-phenylene | 0 | CONH | 20 |
| 1 (4-) | (3-OH) | 0 | OCONH | p-phenylene | 0 | NHCONH | 18 |
| 1 (4-) | (3-$OCH_3$) | 1 | NHCOO | p-phenylene | 0 | OCO | 14 |
| 1 (4-) | (3-OH) | 0 | OCONH | p-phenylene | 0 | COO | 18 |
| 1 (4-) | (3-Cl) | 0 | NHCOO | p-phenylene | 0 | $SO_2$ | 18 |
| 1 (4-) | (3-OH) | 0 | OCONH | p-phenylene | 0 | $SO_2NH$ | 18 |
| 1 (4-) | — | 0 | OCO | — | 0 | — | 18 |
| 1 (4-) | — | 1 | COO | — | 0 | — | 20 |
| 2 (3-, 5-) | — | 0 | OCO | — | 0 | — | 14 |
| 2 (4-) | (3-OH) | 0 | COO | — | 0 | — | 18 |

TABLE 12

| n | R | P | X | B | q | Y | r |
|---|---|---|---|---|---|---|---|
| 1 (4-) | (2-$CH_3$) | 0 | OCO | — | 0 | — | 16 |
| 1 (4-) | (3-Cl) | 2 | COO | — | 0 | — | 18 |
| 1 (3-) | (4-OH) | 0 | OCO | — | 0 | — | 22 |
| 1 (4-) | (3-OH) | 0 | COO | — | 6 | O | 14 |
| 1 (4-) | (3-OH) | 1 | OCO | p-phenylene | 0 | O | 18 |
| 1 (4-) | (3-Cl) | 0 | COO | p-phenylene | 0 | S | 16 |
| 1 (3-) | (4-OH) | 0 | OCO | p-phenylene | 0 | NHCO | 18 |
| 1 (3-) | (4-OH) | 0 | COO | p-phenylene | 0 | CONH | 20 |
| 1 (4-) | (3-OH) | 0 | OCO | p-phenylene | 0 | NHCONH | 18 |
| 1 (4-) | (3-$OCH_3$) | 1 | COO | p-phenylene | 0 | OCO | 14 |
| 1 (4-) | (3-OH) | 0 | OCO | p-phenylene | 0 | COO | 18 |
| 1 (4-) | (3-Cl) | 0 | COO | p-phenylene | 0 | $SO_2$ | 18 |
| 1 (4-) | (3-OH) | 0 | OCO | p-phenylene | 0 | $SO_2NH$ | 18 |
| 1 (4-) | — | 0 | O | — | 0 | — | 18 |
| 1 (4-) | — | 2 | S | — | 0 | — | 20 |
| 2 (3-, 5-) | — | 0 | O | — | 0 | — | 14 |
| 2 (4-) | (3-OH) | 0 | S | — | 0 | — | 18 |
| 1 (4-) | (2-$CH_3$) | 0 | O | — | 0 | — | 16 |
| 1 (4-) | (3-Cl) | 2 | S | — | 0 | — | 18 |
| 1 (3-) | (4-OH) | 0 | O | — | 0 | — | 22 |
| 1 (4-) | (3-OH) | 0 | S | — | 6 | O | 14 |
| 1 (4-) | (3-OH) | 1 | O | p-phenylene | 0 | O | 18 |
| 1 (4-) | (3-Cl) | 0 | S | p-phenylene | 0 | CO | 16 |
| 1 (3-) | (4-OH) | 0 | O | p-phenylene | 0 | NHCO | 18 |
| 1 (3-) | (4-OH) | 0 | S | p-phenylene | 0 | CONH | 20 |
| 1 (4-) | (3-OH) | 0 | O | p-phenylene | 0 | NHCONH | 18 |
| 1 (4-) | (3-$OCH_3$) | 1 | S | p-phenylene | 0 | OCO | 14 |
| 1 (4-) | (3-OH) | 0 | O | p-phenylene | 0 | COO | 18 |
| 1 (4-) | (3-Cl) | 0 | S | p-phenylene | 0 | $SO_2$ | 18 |
| 1 (4-) | (3-OH) | 0 | O | p-phenylene | 0 | $SO_2NH$ | 18 |

TABLE 12-continued

| n | R | P | X | B | q | Y | r |
|---|---|---|---|---|---|---|---|
| 1 (4-) | — | 0 | $SO_2$ | — | 0 | — | 18 |
| 1 (4-) | — | 1 | $SO_2NH$ | — | 0 | — | 20 |
| 2 (3-, 5-) | — | 0 | $SO_2$ | — | 0 | — | 14 |
| 2 (4-) | (3-OH) | 0 | $SO_2NH$ | — | 0 | — | 18 |
| 1 (4-) | (2-$CH_3$) | 0 | $SO_2$ | — | 0 | — | 16 |
| 1 (4-) | (3-Cl) | 2 | $SO_2NH$ | — | 0 | — | 18 |

TABLE 13

| n | R | P | X | B | q | Y | r |
|---|---|---|---|---|---|---|---|
| 1 (3-) | (4-OH) | 0 | $SO_2$ | — | 0 | — | 22 |
| 1 (4-) | (3-OH) | 0 | $SO_2NH$ | — | 6 | O | 14 |
| 1 (4-) | (3-OH) | 1 | $SO_2$ | p-phenylene | 0 | O | 18 |
| 1 (4-) | (3-Cl) | 0 | $SO_2NH$ | p-phenylene | 0 | S | 16 |
| 1 (3-) | (4-OH) | 0 | $SO_2$ | p-phenylene | 0 | NHCO | 18 |
| 1 (3-) | (4-OH) | 0 | $SO_2NH$ | p-phenylene | 0 | CONH | 20 |
| 1 (4-) | (3-OH) | 0 | $SO_2$ | p-phenylene | 0 | NHCONH | 18 |
| 1 (4-) | (3-$OCH_3$) | 1 | $SO_2NH$ | p-phenylene | 0 | OCO | 14 |
| 1 (4-) | (3-OH) | 0 | $SO_2$ | p-phenylene | 0 | COO | 18 |
| 1 (4-) | (3-Cl) | 0 | $SO_2NH$ | p-phenylene | 0 | $SO_2$ | 18 |
| 1 (4-) | (3-OH) | 0 | $SO_2$ | p-phenylene | 0 | $SO_2NH$ | 18 |

Phenolic compounds having a moiety capable of controlling inter-molecular cohesive force are also preferably used as a color developer. For example, phenolic compounds having the following formula (3) can be used.

(3)

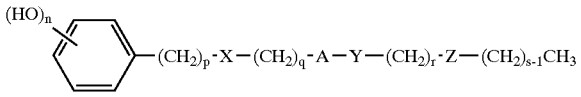

Specific examples of the phenolic compounds having formula (3) include the compounds as shown in Tables 14 to 18 in which the number of p, q, r and s of each compound, and the structure of X, A, Y and Z thereof are shown. In each compound, n is an integer of from 1 to 3, and therefore the left side group (i.e., the phenyl group) is a phenyl group having at least one hydroxyl group, such as a 4-hydroxylphenyl group, a 3-hydroxylphenyl group, a 2-hydroxylphenyl group, a 2,4-dihydroxylphenyl group, a 3,4-dihydroxylphenyl group, and a 2,3,4-trihydroxylphenyl group. The phenyl group may have a substituent other than a hydroxyl group. The left side group is not limited to a phenyl group, and may be a group having an aromatic ring.

TABLE 14

| p | X | q | A | Y | r | Z | s |
|---|---|---|---|---|---|---|---|
| 0 | NHCO | 0 | — | — | 0 | — | 21 |
| 2 | NHCO | 0 | — | — | 0 | — | 18 |
| 2 | NHCO | 1 | — | NHCONH | 0 | — | 16 |
| 0 | NHCO | 1 | — | NHCO | 0 | — | 19 |
| 0 | NHCO | 1 | — | NHCOCONH | 0 | — | 18 |
| 0 | NHCO | 1 | — | NHCO | 3 | NHCONH | 18 |
| 2 | NHCO | 2 | — | CONH | 0 | — | 18 |
| 0 | NHCO | 5 | — | NHCONH | 0 | — | 18 |
| 0 | NHCO | 10 | — | NHCOCONH | 0 | — | 14 |
| 0 | NHCO | 2 | — | CONHNHCO | 0 | — | 17 |
| 2 | NHCO | 10 | — | CONHCONH | 0 | — | 16 |
| 0 | NHCO | 7 | — | NHCONHCO | 0 | — | 11 |
| 0 | NHCO | 6 | — | CONHNHCONH | 0 | — | 18 |
| 2 | NHCO | 11 | — | NHCONHNHCO | 0 | — | 17 |
| 0 | NHCO | 3 | — | NHCONHNH | 0 | — | 18 |
| 0 | NHCO | 5 | — | $SO_2$ | 0 | — | 18 |
| 0 | NHCO | 5 | — | NHCO | 5 | NHCONH | 14 |
| 2 | NHCO | 11 | — | CONH | 1 | CONHNHCO | 13 |
| 0 | NHCO | 1 | p-phenylene | O | 0 | — | 18 |
| 0 | NHCO | 2 | p-phenylene | NHCONH | 0 | — | 18 |
| 0 | NHCO | 4 | — | OCO | 0 | — | 15 |
| 0 | NHCO | 6 | — | SCO | 0 | — | 17 |
| 2 | NHCO | 2 | — | OCONH | 0 | — | 14 |
| 0 | NHCO | 10 | — | S | 0 | — | 20 |

TABLE 15

| p | X | q | A | Y | r | Z | s |
|---|---|---|---|---|---|---|---|
| 1 | CONH | 6 | — | $SO_2$ | 0 | — | 21 |
| 2 | CONH | 3 | — | COO | 0 | — | 18 |
| 1 | CONH | 1 | — | NHCO | 0 | — | 19 |
| 2 | CONH | 2 | — | CONH | 0 | — | 18 |
| 2 | CONH | 5 | — | NHCONH | 0 | — | 18 |
| 1 | CONH | 10 | — | NHCOCONH | 0 | — | 14 |
| 2 | CONH | 2 | — | CONHNHCO | 0 | — | 17 |
| 2 | CONH | 10 | — | CONHCONH | 0 | — | 16 |
| 3 | CONH | 7 | — | NHCONHCO | 0 | — | 11 |
| 1 | NHCONH | 6 | — | CONHNHCONH | 0 | — | 18 |
| 2 | NHCONH | 11 | — | NHCOCONH | 0 | — | 16 |
| 2 | NHCONH | 3 | — | NHCO | 0 | — | 18 |
| 1 | NHCONH | 5 | — | $SO_2$ | 0 | — | 18 |
| 2 | NHCONH | 5 | — | CONHNHCO | 5 | NHCONH | 18 |
| 2 | CONHNHCO | 11 | — | NHCO | 0 | — | 14 |
| 1 | CONHNHCO | 6 | — | O | 6 | NHCOCONH | 18 |
| 2 | CONHNHCO | 2 | p-phenylene | NHCONH | 0 | — | 18 |
| 2 | COO | 1 | — | NHCO | 0 | — | 19 |
| 1 | COO | 5 | — | NHCONH | 0 | — | 18 |
| 2 | COO | 2 | — | CONHNHCO | 0 | — | 17 |
| 2 | COO | 7 | — | NHCONHCO | 0 | — | 11 |

TABLE 15-continued

| p | X | q | A | Y | r | Z | s |
|---|---|---|---|---|---|---|---|
| 2 | COO | 11 | — | NHCONHNHCO | 0 | — | 17 |
| 2 | COO | 3 | — | NHCONHNH | 0 | — | 18 |
| 1 | COO | 5 | — | $SO_2$ | 0 | — | 18 |
| 2 | COO | 11 | — | CONH | 1 | CONHNHCO | 14 |
| 2 | COO | 2 | p-phenylene | NHCONH | 0 | — | 18 |
| 3 | SCO | 5 | — | NHCONH | 0 | — | 18 |
| 2 | COS | 10 | — | NHCOCONH | 0 | — | 14 |
| 6 | SCO | 2 | — | NHCONHNHCO | 0 | — | 17 |
| 2 | COS | 10 | — | NHCONHCO | 0 | — | 16 |
| 2 | CONH | 7 | — | CONHNHCO | 0 | — | 11 |
| 1 | CONH | 6 | — | CONHNHCONH | 0 | — | 18 |
| 2 | CONH | 2 | — | NHCONHNHCO | 0 | — | 17 |
| 2 | CONH | 3 | — | NHCONHNH | 0 | — | 18 |
| 3 | CONH | 5 | — | $SO_2$ | 0 | — | 18 |
| 1 | CONH | 6 | — | NHCO | 5 | NHCONH | 18 |

TABLE 16

| p | X | q | A | Y | r | Z | s |
|---|---|---|---|---|---|---|---|
| 2 | CONH | 11 | — | CONH | 1 | — | 14 |
| 2 | CONH | 4 | — | O | 0 | NHCOCONH | 18 |
| 1 | CONH | 2 | p-phenylene | NHCONH | 0 | — | 18 |
| 1 | NHCOCONH | 10 | — | CONH | 0 | — | 22 |
| 2 | NHCOCONH | 3 | — | $SO_2$ | 0 | — | 18 |
| 2 | OCONH | 4 | — | NHCO | 0 | — | 19 |
| 2 | NHCOO | 2 | — | CONH | 0 | — | 18 |
| 3 | OSONH | 5 | — | NHCONH | 0 | — | 18 |
| 2 | $NHSO_2$ | 10 | — | NHCOCONH | 0 | — | 14 |
| 1 | $NHSO_2$ | 2 | — | CONHNHCO | 0 | — | 17 |
| 2 | NHSOO | 7 | — | NHCONHCO | 0 | — | 11 |
| 3 | $SO_2$ | 6 | — | CONHNHCONH | 0 | — | 18 |
| 2 | $SO_2$ | 11 | — | NHCONHNHCO | 0 | — | 17 |
| 1 | $SO_2$ | 3 | — | NHCONHNH | 0 | — | 18 |
| 2 | NHCO | 1 | — | NHCOCONH | 0 | — | 16 |
| 2 | NHCO | 1 | — | NHCONH | 0 | — | 14 |
| 1 | CONHNHCO | 1 | — | NHCONHNH | 0 | — | 18 |
| 2 | CONHNHCO | 1 | — | $NHSO_2$ | 0 | — | 18 |
| 2 | NHCONHCO | 1 | — | NHCONHCO | 0 | — | 17 |
| 1 | NHCONHCO | 1 | — | NHCO | 10 | NHCONH | 18 |
| 2 | CONHCO | 1 | — | NHNHCONH | 0 | — | 12 |

TABLE 17

| p | X | q | A | Y | r | Z | s |
|---|---|---|---|---|---|---|---|
| 0 | CONHCONH | 8 | — | $SO_2$ | 0 | — | 18 |
| 0 | CONHCONH | 5 | — | NHCO | 5 | NHCONH | 18 |
| 0 | CONHCONH | 11 | — | CONH | 0 | — | 14 |
| 0 | CONHCONH | 2 | p-phenylene | O | 0 | — | 18 |
| 0 | CONHCONH | 2 | p-phenylene | S | 0 | — | 18 |
| 0 | CONHCONH | 2 | p-phenylene | COO | 0 | — | 21 |
| 0 | CH=N | 10 | — | NHCOCONH | 0 | — | 18 |
| 0 | CH=N | 1 | — | NHCONH | 0 | — | 20 |
| 0 | CH=N | 2 | p-phenylene | CONH | 0 | — | 18 |
| 0 | CONH | 0 | — | — | 0 | — | 22 |
| 0 | COO | 0 | — | — | 0 | — | 16 |
| 0 | S | 0 | — | — | 0 | — | 18 |
| 0 | $NHSO_2$ | 0 | — | — | 0 | — | 14 |
| 0 | $SO_2$ | 0 | — | — | 0 | — | 18 |
| 0 | O | 0 | — | — | 0 | — | 20 |
| 0 | OCOO | 0 | — | — | 0 | — | 18 |
| 0 | $SO_2NH$ | 0 | — | — | 0 | — | 18 |
| 0 | NHCONH | 0 | — | — | 0 | — | 18 |
| 0 | COS | 0 | — | — | 0 | — | 14 |
| 0 | SCO | 0 | — | — | 0 | — | 17 |
| 0 | $NHSO_2$ | 0 | — | — | 0 | — | 18 |

TABLE 17-continued

| p | X | q | A | Y | r | Z | s |
|---|---|---|---|---|---|---|---|
| 0 | NHCOO | 0 | — | — | 0 | — | 22 |
| 0 | NHSONH | 0 | — | — | 0 | — | 18 |
| 0 | N=CH | 0 | — | — | 0 | — | 17 |
| 0 | CO | 0 | — | — | 0 | — | 15 |
| 0 | CONHNHCO | 0 | — | — | 0 | — | 18 |
| 0 | OCO | 0 | — | — | 0 | — | 17 |
| 0 | OCONH | 0 | — | — | 0 | — | 16 |
| 0 | SCOO | 0 | — | — | 0 | — | 14 |
| 0 | SCONH | 0 | — | — | 0 | — | 18 |
| 0 | NHCOCONH | 0 | — | — | 0 | — | 18 |
| 1 | NHCO | 0 | — | — | 0 | — | 17 |
| 3 | NHCO | 0 | — | — | 0 | — | 15 |
| 2 | NHCONH | 0 | — | — | 0 | — | 18 |
| 1 | NHCONH | 0 | — | — | 0 | — | 16 |
| 4 | CONHNHCO | 0 | — | — | 0 | — | 17 |
| 2 | CONHNHCO | 0 | — | — | 0 | — | 21 |
| 2 | NHCOCONH | 0 | — | — | 0 | — | 18 |
| 2 | CONHCONH | 0 | — | — | 0 | — | 20 |
| 2 | OCONH | 0 | — | — | 0 | — | 18 |

TABLE 18

| p | X | q | A | Y | r | Z | s |
|---|---|---|---|---|---|---|---|
| 0 | NHCO | 0 | p-phenylene | O | 0 | — | 22 |
| 0 | NHCO | 0 | p-phenylene | NHCONH | 0 | — | 18 |
| 0 | CONH | 0 | p-phenylene | CONH | 0 | — | 18 |
| 0 | CONH | 0 | p-phenylene | CONHNHCO | 0 | — | 17 |
| 0 | $NHSO_2$ | 0 | p-phenylene | NHCO | 0 | — | 19 |
| 0 | S | 0 | p-phenylene | CONH | 0 | — | 18 |
| 0 | S | 0 | p-phenylene | NHCOO | 0 | — | 18 |
| 0 | S | 0 | p-phenylene | NHCOCONH | 0 | — | 16 |
| 0 | NHCONH | 0 | p-phenylene | NHCONH | 0 | — | 14 |
| 0 | NHCONH | 0 | p-phenylene | CONHNHCO | 0 | — | 17 |
| 0 | CH=N | 0 | p-phenylene | CONHCONH | 0 | — | 16 |
| 0 | N=CH | 0 | p-phenylene | S | 0 | — | 18 |
| 0 | NHCSNH | 0 | p-phenylene | COO | 0 | — | 20 |
| 0 | S | 1 | p-phenylene | NHCONH | 0 | — | 18 |
| 0 | S | 2 | p-phenylene | NHCONHNH | 0 | — | 18 |
| 0 | NHCO | 1 | p-phenylene | NHCONHCO | 0 | — | 19 |
| 0 | NHCO | 2 | p-phenylene | NHCO | 0 | — | 17 |
| 0 | CONH | 2 | p-phenylene | OCONH | 0 | — | 18 |
| 0 | CONH | 1 | p-phenylene | CONHNHCO | 0 | — | 17 |
| 0 | CONH | 1 | — | NHCO | 0 | — | 21 |
| 0 | CONH | 2 | — | NHCONH | 0 | — | 18 |
| 0 | S | 2 | — | NHCONH | 0 | — | 19 |
| 0 | S | 10 | — | NHCONH | 0 | — | 18 |
| 0 | S | 2 | — | CONHNHCO | 0 | — | 17 |
| 0 | S | 2 | — | CONHNHCONH | 0 | — | 14 |
| 0 | S | 1 | — | CONH | 0 | NHCONH | 18 |
| 0 | S | 2 | — | CONH | 1 | NHCO | 17 |
| 1 | CONH | 1 | — | NHCO | 0 | — | 17 |
| 2 | CONH | 1 | — | NHCONH | 0 | — | 18 |
| 0 | NHCO | 1 | — | CONH | 0 | — | 18 |
| 0 | NHCO | 1 | — | CONHNHCO | 0 | — | 17 |
| 0 | CONHNHCO | 2 | — | S | 0 | — | 12 |
| 0 | CONHNHCO | 10 | — | S | 0 | — | 10 |
| 2 | CONHNHCO | 2 | — | S | 0 | — | 14 |
| 0 | S | 10 | — | CONHNHCO | 2 | S | 18 |
| 0 | $SO_2NHCONH$ | 2 | p-phenylene | NHCONH | 0 | — | 18 |
| 0 | $SO_2NHCONH$ | 0 | p-phenylene | COO | 0 | — | 18 |
| 0 | $SO_2$ | 10 | — | NHCONH | 0 | — | 18 |
| 0 | $SO_2$ | 6 | — | CONHNHCO | 0 | — | 19 |
| 0 | $SO_2$ | 0 | p-phenylene | CONHNHCO | 0 | — | 18 |

The coloring agent for use in the present invention has electron donating property, and is a colorless or pale-colored dye precursor (i.e., a leuco dye). Suitable coloring agents for use in the present invention include known leuco dyes such as phthalides compounds, azaphthalide compounds, fluoran compounds, phenothiazine compounds, leuco auramine compounds, etc.

Specific examples of leuco dyes, which can preferably used as a coloring agent in the recording layer of the recording material of the present invention, include compounds having one of the following formulae (4) and (5):

(4)

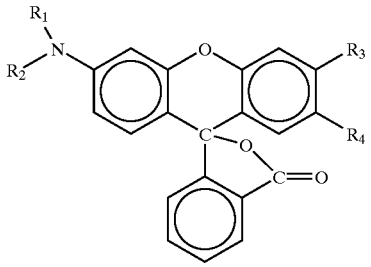

-continued (5)

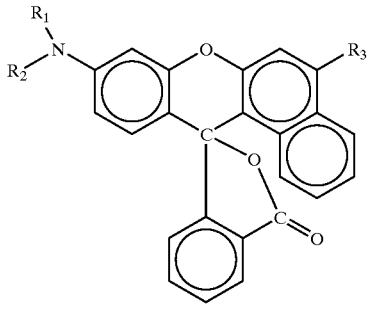

wherein $R_1$ represents a hydrogen atom or an alkyl group having 1 to 4 carbon atoms; $R_2$ represents an alkyl group having 1 to 6 carbon atoms, a cycloalkyl group, or a phenyl group which is optionally substituted with an alkyl group such as a methyl group and an ethyl group, an alkoxyl group such as a methoxy group and ethoxy group, a halogen atom, etc.; $R_3$ represents a hydrogen atom, an alkyl group having 1 to 2 carbon atoms, an alkoxyl group or a halogen atom; and $R_4$ represents a hydrogen atom, a methyl group, a halogen atom, or an amino group which is optionally substituted by an alkyl group, an aryl group optionally substituted by an alkyl group, a halogen atom, an alkoxyl group, etc. or an aralkyl group optionally substituted by an alkyl group, a halogen atom, an alkoxyl group, etc.

Specific examples of the coloring agents include:

2-anilino-3-methyl-6-diethylaminofluoran,
2-anilino-3-methyl-6-di(n-butylamino)fluoran,
2-anilino-3-methyl-6-(N-n-propyl-N-methylamino) fluoran,
2-anilino-3-methyl-6-(N-isopropyl-N-methylamino) fluoran,
2-anilino-3-methyl-6-(N-isobutyl-N-methylamino) fluoran,
2-anilino-3-methyl-6-(N-n-amyl-N-methylamino) fluoran,
2-anilino-3-methyl-6-(N-sec-butyl-N-methylamino) fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino)-fluoran,
2-anilino-3-methyl-6-(N-cyclohexyl-N-methylamino)-fluoran,
2-anilino-3-methyl-6-(N-ethyl-p-toluidino) fluoran,
2-anilino-3-methyl-6-(N-methyl-p-toluidino) fluoran,
2-(m-trichloromethylanilino)-3-methyl-6-diethylamino-fluoran,
2-(m-trifluoromethylanilino)-3-methyl-6-diethylamino-fluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino)-fluoran,
2-(N-ethyl-p-toluidino)-3-methyl-6-(N-propyl-p-toluidino)fluoran,
2-anilino-6-(N-n-hexyl-N-ethylamino) fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2-(p-acetylanilino)-6-(N-n-amyl-N-n-butylamino) fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino) fluoran,
2-dibenzylamino-6-(N-ethyl-p-toluidino)fluoran,
2-(di-p-methylbenzylamino)-6-(N-ethyl-p-toluidino)-fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino) fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethyanilino)fluoran,
2-amino-6-(N-propyl-2,4-dimethylanilino)fluoran,
2-amino-6-(N-methyl-2,4-dimethylanilino)fluoran,
2-amino-6-(N-methyl-p-chloroanilino) fluoran,
2-amino-6-(N-ethyl-p-chloroanilino) fluoran,
2-amino-6-(N-propyl-p-chloroanilino) fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylamino-fluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran,
1,2-benzo-6-dibuylaminofluoran,
1,2-benzo-6-(N-methyl-N-cyclohexylamino)fluoran,
1,2-benzo-6-(N-ethyl-N-toluidino)fluoran, etc.

The following compounds can also be used as a coloring agent in the present invention.

2-anilino-3-methyl-6-(N-2-ethoxylpropyl-N-ethylamino) fluoran,
2-(p-chloroanilino)-6-(N-n-octylamino)fluoran,
2-(p-chloroanilino)-6-(N-n-palmitylamino) fluoran
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-dibenzylamino-4-methyl-6-(N-ethyl-p-toluidino) fluoran,
2-(α-phenylethylamino)-4-methyl-6-diethylaminofluoran,
2-(p-toluidino)-3-(t-butyl)-6-(N-methyl-p-toluidino) fluoran,
2-(o-methoxycarbonylanilino)-6-diethylaminofluoran,
2-acetylamino-6-(N-methyl-p-toluidino)fluoran, 3-diethylamino-6-(m-trifluoromethylanilino)fluoran, 4-methoxy-6-(N-ethyl-p-toluidino)fluoran, 2-ethoxyethylamino-3-chloro-6-dibutylaminofluoran, 2-dibenzylamino-4-chloro-6-(N-ethyl-p-toluidino) fluoran, 2-(α-phenylethylamino)-4-chloro-6-diethylaminofluoran, 2-(N-benzyl-p-trifluoromethylanilino)-4-chloro-6-diethylaminofluoran, 2-anilino-3-methyl-6-pyrrolidinofluoran, 2-anilino-3-chloro-6-pyrrolidinofluoran, 2-anilino-3-methyl-6-(N-ethyl-N-tetrahydrofurfurylamino) fluoran, 2-mesidino-4',5'-benzo-6-diethylaminofluoran, 2-(m-trifluoromethylanilino)-3-methyl-6-pyrrolidino fluoran, 2-(α-naphthylamino)-3,4-benzo-4'-bromo-6-(N-benzyl-N-cyclohexylamino)fluoran, 2-piperidino-6-diethylaminofluoran, 2-(N-n-propyl-p-trifluoromethylanilino)-6-morpholino fluoran, 2-(di-N-p-chlorophenyl-methylamino)-6-pyrrolidino fluoran, 2-(N-n-propyl-m-trifluoromethylanilino)-6-morpholino fluoran, 1,2-benzo-6-(N-ethyl-N-n-octylamino)fluoran, 1,2-benzo-6-diallylaminofluoran, 1,2-benzo-6-(N-ethoxyethyl-N-ethylamino)fluoran, benzoleucomethyleneblue, 2-[3,6-bis(diethylamino)]-6-(o-chloroanilino)xanthyl benzoic acid lactam, 2-[3,6-bis(diethylamino)]-9-(o-chloroanilino)xanthyl benzoic acid lactam, 3,3-bis(p-dimethylaminophenyl)phthalide, 3,3-bis(p-dimethylaminophenyl)-6-dimethylaminophthalide (i.e., crystal violet lactone)

3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-(2-methoxy-4-dimethylaminophenyl)-3-(2-hydroxy-4,5-dichlorophenyl) phthalide, 3-(2-hydroxy-4-dimethylaminophenyl)-3-(2-methoxy-5-chlorophenyl)phthalide, 3-(2-hydroxy-4-dimethoxyaminophenyl)-3-(2-methoxy-5-chlorophenyl)phthalide, 3-(2-hydroxy-4-dimethylaminophenyl)-3-(2-methoxy-5-nitrophenyl)phthalide, 3-(2-hydroxy-4-diethylaminophenyl)-3-(2-methoxy-5-methylphenyl)phthalide, 3-(2-methoxy-4-dimethylaminophenyl)-3-(2-hydroxy-4-chloro-5-methoxyphenyl)phthalide, 3,6-bis(dimethylamino)fluorenespiro(9,3')-6'-dimethylaminophthalide, 3-(1-ethyl-2-methylindole-3-yl)-3-(2-ethoxy-4-diethylaminophenyl)-4-azaphthalide, 3-(1-octyl-2-methylindole-3-yl)-3-(2-ethoxy-4-diethylaminophenyl)-4-azaphthalide, 3-(1-ethyl-2-methylindole-3-yl)-3-(2-ethoxy-4-diethylaminophenyl)-7-azaphthalide, 3,3-bis(2-ethoxy-4-diethylaminophenyl)-4-azaphthalide, 3,3-bis(2-ethoxy-4-diethylaminophenyl)-7-azaphthalide, 6'-chloro-8'-methoxy-benzoindolino-spiropyran, 6'-bromo-2'-methoxy-benzoindolino-spiropyran, etc.

The recording layer of the reversible thermosensitive recording material includes at least a coloring agent (such as the coloring agents mentioned above), a color developer (such as the color developer mentioned above) and a crosslinked resin.

The mole ratio (C/D) of the coloring agent (C) to the color developer (D) is from 10/1 to 1/20, and preferably from 5/1 to 1/10. When the ratio is too large or small, a problem in that the density of colored recording layer decreases occurs.

A coloring agent and a color developer each of which is microencapsulated can also be used.

The weight ratio (C/R) of the coloring agent (C) to the crosslinked resin (R) in the recording layer is from 10/1 to 1/10. When the content of the crosslinked resin is too low, a problem such that the recording layer has poor heat resistance occurs. In contrast, when the resin content is too high, a problem such that the density of colored recording layer decreases occurs.

The recording layer can be prepared using a coating liquid in which a color developer, a coloring agent, a crosslinkable resin and a solvent are uniformly mixed and dispersed.

Specific examples of the solvent for use in the recording layer coating liquid include water; alcohols such as methanol, ethanol, isopropanol, n-butanol, and methylisocarbitol; ketones such as acetone, 2-butanone, ethyl amyl ketone, diacetone alcohol, isophorone, and cyclohexanone; amides such as N,N-dimethylformamide and N,N-dimethylacetoamide; ethers such as diethyl ether, isopropyl ether, tetrahydrofuran, 1,4-dioxane and 3,4-dihydro-2H-pyrane; glycol ethers such as 2-methoxyethanol, 2-ethoxyethanol, 2-butoxyethanol and ethyleneglycol dimethyl ether; glycol ether acetates such as 2-methoxyethyl acetate, 2-ethoxyethyl acetate and 2-butoxyethyl acetate; esters such as methyl acetate, ethyl acetate, isobutyl acetate, amyl acetate, ethyl lactate and ethylene carbonate; aromatic hydrocarbons such as benzene, toluene and xylene; aliphatic hydrocarbons such as hexane, heptane, iso-octane and cycolhexane; halogenated hydrocarbons such as methylene chloride, 1,2-dichloroethane, dichloropropane and chlorobenzene; sufoxides such as dimethyl sulfoxide; pyrrolidones such as N-methyl-2-pyrrolidone and N-octyl-2-pyrrolidone, etc.

The recording layer coating liquid can be prepared using a dispersion machine such as paint shakers, ball mills, attritors, three-roll mills, keddy mills, sand mills, dyno mills and colloid mills. Components such as a coloring agent, a color developer and a resin may be dissolved or dispersed in a solvent at the same time using one of the dispersion machines, or a solution or dispersion of each component, which is separately prepared, by may be mixed. When a dispersion is prepared, a method in which a mixture of a component with a solvent is at first heated to prepared a solution and then rapidly or gradually cooled to precipitate the component in the solvent can also be used.

The recording layer can be coated by any known coating method such as blade coating, wire bar coating, spray coating, air knife coating, bead coating, curtain coating, gravure coating, kiss coating, reverse roll coating, dip coating, and die coating methods.

After the recording layer coating liquid is coated and dried, the resultant recording layer is subjected to a crosslinking treatment if desired. When a heat-crosslinkable resin is used, the recording layer is preferable subjected to a heat treatment. When an ultraviolet crosslinking resin or an electron beam crosslinking resin is used, the recording layer is crosslinked using any known crosslinking device emitting ultraviolet rays or electron beams.

As an ultraviolet ray source, mercury lamps, metal halide lamps, gallium lamps, mercury-xenon lamps, flash lamps, etc., can be used. It is preferable to select a light source such that the light emitted by the light source can be effectively absorbed by the photopolymerization initiator and photopolymerization accelerator included in the recording layer. It is preferable to determine the ultraviolet irradiation conditions, such as power of the lamp and feeding speed of the recording layer to be crosslinked, depending on the energy needed for crosslinking the resin in the recording layer.

When an electron beam irradiating device is used, a scanning type irradiating device or non-scanning type irradiating device is selected depending on the area of the recording layer to be irradiated, and the dose needed for crosslinking the resin in the recording layer. In addition, irradiation conditions such as amount of electron flow, irradiation width and feeding speed should be determined depending on the dose needed for crosslinking the resin in the recording layer.

The thickness of the recording layer is preferably from 1 to 20 μm, and more preferably from 3 to 10 μm.

Suitable materials for use as the substrate of the recording material of the present invention include paper, resin films, synthetic paper, metal foils, glass and combinations thereof, etc. The substrate is not limited thereto, and any material capable of supporting the recording layer can be used as the substrate. The thickness of the substrate is determined depending on the purpose of the resultant recording material.

The reversible thermosensitive recording material of the present invention can have an information recording portion on a part of the surface of the recording side of the recording material or a part of or entire the surface of the backside of the substrate. Specific examples of such information recording portions include magnetic information storage devices such as magnetic stripes and magnetic recording layers; IC chips; optical information storage devices, etc., but are not limited thereto.

In addition, the recording material of the present invention can be used as a reversible thermosensitive recording label by forming an adhesive layer on the backside of the substrate. This label can be adhered on a material such as cards (e.g., credit cards, IC cards, IC chips and ID cards), paper, films, synthetic paper, boarding passes, commuter passes, disc cartridges, tape cassettes, CD-R, CD-WR, DVD, etc.

The recording layer may include additives to improve coating properties, and color formation/erasure properties. Such additives include dispersants, surfactants, electroducductive agents, fillers, lubricants, antioxidants, photostabilizers, ultraviolet absorbents, color stabilizers, and decoloring accelerators.

The recording layer may include a thermoplastic resin together with one or more of the crosslinked resins mentioned above. Specific examples of such resins include polyvinyl chloride, polyvinyl acetate, vinyl chloride-vinyl acetate copolymers, polystyrene, styrene copolymers, phenoxy resins, polyester, aromatic polyester, polyurethane, polycarbonate, polyacrylate, polymethacrylate, acrylic copolymers, and maleic acid copolymers.

The protective layer of the recording material of the present invention includes at least a filler and a crosslinked resin. As the crosslinked resin, for example, the crosslinkable resins mentioned above for use in the recording layer can be used.

As the filler, inorganic fillers and organic fillers can be used.

Specific examples of the inorganic fillers include carbonates such as calcium carbonate and magnesium carbonate; silicates such as silicic acid anhydride, hydrated silicic acid, hydrated aluminum silicate and hydrated calcium silicate; oxides such as alumina, zinc oxide, iron oxide and calcium oxide; hydroxides such as aluminum hydroxide; etc. Among these fillers, fillers having an average particle diameter not greater than 6 μm are preferably used to impart good mechanical durability to the resultant recording material.

In addition, fillers having an average particle diameter not greater than 0.1 μm are preferably used to improve the light resistance of the recording material. Specific examples of such fillers include metal oxides such as zinc oxide, indium oxide, alumina, silica, zirconium oxide, tin oxide, cerium oxide, iron oxide, antimony oxide, barium oxide, calcium oxide, barium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate and potassium titanate, and their complexes; sulfides and sulfates such as zinc sulfide and barium sulfate; metal carbide such as titanium carbide, silicon carbide, molybdenum carbide, tungsten carbide and tantalum carbide; nitrides such as aluminum nitride, silicon nitride, boron nitride, zirconium nitride, vanadium nitride, titanium nitride, niobium nitride and gallium nitride; etc.

Among these fillers having an average particle diameter not greater than 0.1 μm, fillers capable of absorbing light having a wavelength not greater than 400 nm are more preferably used. These fillers are classified into a group (A) absorbing UV-A light having a wavelength of from 320 to 400 nm, and another group (B) absorbing UV-B absorbing light having a wavelength less than 320 nm. In the present invention, a filler of the group (A) or (B) can be used alone, however it is preferable to use a combination of a filler in the group (A) and a filler in the group (B) to heighten the effect of the present invention.

Specific examples of the fillers in the group (A) include zinc oxide, titanium oxide, indium oxide, cerium oxide, tin oxide, molybdenum oxide, zinc sulfide, gallium oxide, etc.

Specific examples of the fillers in the group (B) include silica, alumina, silica-alumina, antimony oxide, magnesium oxide, zirconium oxide, barium oxide, calcium oxide, strontium oxide, silicon nitride, boron nitride, barium sulfate, etc.

A filler having an average particle diameter not greater than 0.1 μm can be prepared by a known method such as vapor-phase reaction methods and liquid-phase reaction methods.

Specific examples of the organic fillers include particulate resins such as silicone resins, cellulose resins, epoxy resins, nylon resins, phenolic resins, polyurethane resins, urea resins, melamine resins, polyester reins, polycarbonate resins, styrene resins such as polystyrene, styrene-isoprene copolymers and styrene-vinyl benzene copolymers, acrylic resins such as vinylidene chloride-acrylic copolymers, acrylic urethane resins and ethylene-acrylic copolymers, polyethylene resins, formaldehyde resins such as benzoguanamine formaldehyde resins and melamine formaldehyde resins, polymethylmethacrylate resins, vinyl chloride resins, etc. The particle diameter of these organic fillers is preferably not greater than 6 μm to impart good mechanical durability to the recording material.

These organic fillers can be used alone or in combination. In addition, complex fillers of these fillers can also be used. The shape of particles of the organic fillers is not particularly limited, and fillers in a spherical, granular, platy or acerose form can be used. However, organic fillers having a spherical form can be preferably used to impart good mechanical durability to the recording material.

As the resin for use in the protective layer, polyvinyl alcohol, styrene-maleic acid anhydride copolymers, carboxyl-modified polyethylene, melamine-formaldehyde resins, urea-formaldehyde resins, etc. can be used other than the crosslinkable resins mentioned above.

The thickness of the protective layer is preferably from 0.1 to 20 $\mu$m, and more preferably from 0.3 to 10 $\mu$m. The content of the filler in the protective layer is preferably from 1 to 95% by volume, and more preferably from 5 to 75% by volume.

The protective layer may include an ultraviolet absorbent. The content of the ultraviolet absorbent in the protective layer is preferably from 0.5 to 10 parts by weight per 100 parts by weight of the binder resin included in the protective layer.

As the solvent for a coating liquid, mixing device for preparing the coating liquid, coating method for coating the protective layer coating liquid, and method for drying and crosslinking the coated liquid, the solvents, devices and methods mentioned above for use in the recording layer can also be used for forming the protective layer.

As mentioned above, the reversible thermosensitive recording material of the present invention include a substrate, a recording layer located overlying the substrate and including a coloring agent, a color developer and a crosslinked resin, and a protective layer located overlying the recording layer and including a filler and a crosslinked resin. However, an adhesive layer, an intermediate layer, an undercoat layer, a back layer, etc can be optionally formed to improve the properties of the recording material. In addition, a magnetic recording layer can also be provided on the recording material. In addition, the substrate and/or one or more of the layers may be colored by a colorant.

An intermediate layer is preferably formed between the recording layer and the protective layer to improve the adhesion of the recording layer to the protective layer, to prevent the recording layer from deteriorating when a protective layer coating liquid is coated on the recording layer, and to prevent the additives in the protective layer from migrating to the recording layer. By forming an intermediate layer, preservability of colored images formed in the recording layer can be improved.

It is preferable to use a resin having a low oxygen transmittance in a layer located overlying the recording layer, such as protective layer and intermediate layer, to improve the light resistance of the recording material. Using such a resin in the layer can prevent the coloring agent and color developer in the recording layer from being oxidized or reduce the chance that they are oxidized.

Forming an intermediate layer can also prevent crystallization of low molecular weight components such as color developers included in the recording layer when a layer is coated on the recording layer or images are repeatedly formed and erased. In this case, the intermediate layer preferably includes an organic low molecular weight compound which can be a crystal nucleus or a filler which can adsorb such an organic low molecular weight compound. The color developer, etc. is adsorbed on such a low molecular weight compound or a filler when the recording material is repeatedly subjected to image formation/erasure operations, and therefore the color developer tends not to be scattered.

Specific examples of the resins for use in the intermediate layer include polyvinyl chloride, polyvinyl acetate, vinyl chloride-vinyl acetate copolymers, polyvinyl acetal, polyvinyl butyral, polycarbonate, polyarylate, polysulfone, polyethersulfone, polyphenyleneoxide, polyimide, fluorine-containing resins, polyamide, polyamideimide, polybenzimidazole, polystyrene, styrene copolymers, phenoxy resins, polyester, aromatic polyester, polyurethane, polyacrylate, polymethacrylate, acrylic copolymers, maleic acid copolymers, epoxy resins, alkyd resins, silicone resins, phenolic resins, polyvinyl alcohol, modified polyvinyl alcohol, polyvinyl pyrrolidone, polyethyleneoxide, polypropyleneoxide, methyl cellulose, ethyl cellulose, carboxymethyl cellulose, hydroxyethyl cellulose, starch, gelatin, casein, etc. Among these resins, the crosslinkable resins for use in the recording layer and the protective layer can also be preferably used to improve the durability of the recording material. It is more preferable to add one or more of the fillers mentioned abvoe for use in the protective layer.

The thickness of the intermediate layer is preferably from 0.1 to 20 $\mu$m, and more preferably from 0.3 to 10 $\mu$m. The content of the filler in the intermediate layer is preferably 1 to 95% by volume and more preferably from 5 to 75% by volume. The intermediate layer may include an ultraviolet absorbent. The content of the ultraviolet absorbent is preferably from 0.5 to 10 parts by weight per 100 parts by weight of the binder resin included in the intermediate layer.

As the solvent for a coating liquid, mixing device for preparing the coating liquid, coating method for coating the intermediate layer coating liquid, and method for drying and crosslinking the coated liquid, the solvents, devices and methods mentioned above for use in the protective layer can also be used.

The recording material may include a heat-insulating undercoat layer between the substrate and the recording layer to effectively utilize the heat applied to the recording layer to form or erase an image. Such an undercoat layer can be formed by coating a coating liquid including organic or inorganic fine hollow particles and a binder resin. An undercoat layer is formed to improve adhesion of the recording layer to the substrate and/or to prevent the materials in the recording layer from migrating to the substrate.

Suitable resins for use in the undercoat layer include the resins mentioned above for use in the recording layer. In addition, a filler such as inorganic fillers, e.g., calcium carbonate, magnesium carbonate, titanium oxide, silica, aluminum hydroxide, kaolin, talc, etc., and organic fillers can be included therein. In addition, additives such as lubricants, surfactants and dispersants can also be used therein.

Images can be recorded in the recording material of the present invention by heating the recording material to a temperature not lower than the image forming temperature. Specifically, when imagewise heating the recording layer for a short time with a thermal printhead, a laser beam or the like, the applied heat rapidly diffuses because the recording layer is locally heated, resulting in rapid cooling of the recording layer, and thereby the colored image can be recorded and maintained.

The recorded image can be erased by heating the recording layer for a relatively long time with an appropriate heating device and then gradually cooling the recording layer, or by heating the recording layer at a temperature in an image erasing temperature range, i.e., at a temperature not lower than the image erasing temperature but lower than the image forming temperature. When the recording layer is heated for a relatively long time, the temperature of the entire portion of the recording material increases and therefore the recording material is gradually cooled. In the gradual cooling process, the image is erased. The long-term heating can be performed by a heat roller, a heat stamp, a hot air blowing device or a thermal printhead. When a thermal printhead is used for the long-term heating, the heat energy applied to the recording layer is preferably controlled so as to be relatively low compared to the heat energy for image recording, by controlling the applied voltage and/or pulse width of a pulse applied to the thermal printhead. By using this method, the image recording and erasing operations can be performed with only one thermal printhead. This method allows the so-called "overwriting".

Of course, it is possible to heat the recording material at a temperature in the image erasing temperature range using a heat roller, a heat stamp, a hot air blowing device to erase an image.

The reversible thermosensitive recording material of the present invention typically has a structure as shown in FIG. 2. In addition, the recording material may have one of the structures as shown in FIGS. 3 to 11. However, the structure of the recording material is not limited the structures as shown in FIGS. 2 to 11.

As can be understood from FIGS. 2 to 11, the outermost layer of the recording material on the recording layer side is not limited to the protective layer, and a print layer, an OP layer, a laminate layer, etc., can be the outermost layer.

In the present invention, the ten-point mean roughness (Rz) of the surface of the outermost layer of the recording material, which contacts a heating device such as a thermal printhead, is not less than 1.5 μm and preferably from 1.5 to 3.5 μm. In addition, the ratio (Sm/Rz) of the average peak-to-peak length (Sm) to the ten-point mean roughness (Rz) is not greater than 120 and preferably from 30 to 120.

The ten-point mean roughness (Rz) and peak-to-peak length (Sm) of the surface of the recording material can be determined by JIS B0610.

JIS B0610 will be explained referring to FIGS. 12A and 12B.

(1) Ten-Point Mean Roughness (Rz)

(A) Definition of Rz

Arithmetic mean of values of ten-point mean roughness measured at various parts chosen at random on the surface of an object.

(B) Method of Obtaining Ten-Point Mean Roughness Rz

Figure 12A:
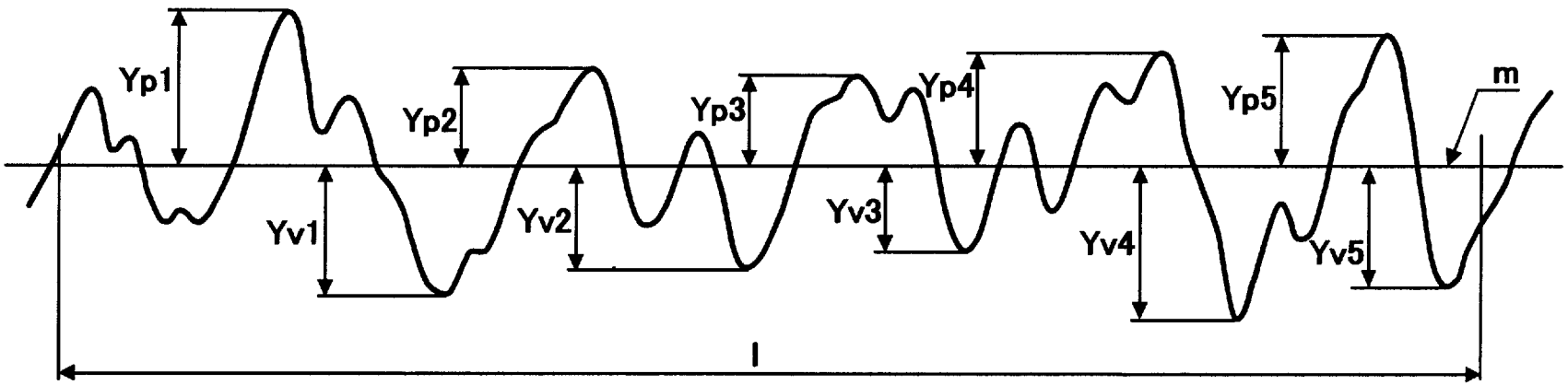
FIGS. 12A and 12B are schematic views for explaining how to determine Rz and Sm.

As shown in FIG. 12A, a portion having a measurement length 1 is sampled from a waviness curve. The heights of the five highest peaks from the center line m (i.e., $Y_{P1}$, $Y_{P2}$, $Y_{P3}$, $Y_{P4}$ and $Y_{P5}$) are measured. In addition, the depths of the five deepest valleys from the center line m (i.e., $Y_{V1}$, $Y_{V2}$, $Y_{V3}$, $Y_{V4}$ and $Y_{V5}$) are measured. The ten-point mean roughness Rz of the surface is determined by the following equation:

$$Rz=(|Y_{P1}+Y_{P2}+Y_{P3}+Y_{P4}+Y_{P5}|+|Y_{V1}+Y_{V2}+Y_{V3}+Y_{V4}+Y_{V5}|)/5$$

The unit of Rz is μm.

The measurement length 1 is selected from the following lengths:

0.08 mm; 0.25 mm; 0.8 mm; 2.5 mm; 8 mm; and 25 mm.

(2) Peak-to-Peak Length (Sm)

(A) Definition of Sm

Arithmetic mean of values of peak-to-peak lengths measured at various parts chosen at random on the surface of an object.

(B) Method of Obtaining Peak-to-Peak Length

Figure 12B:
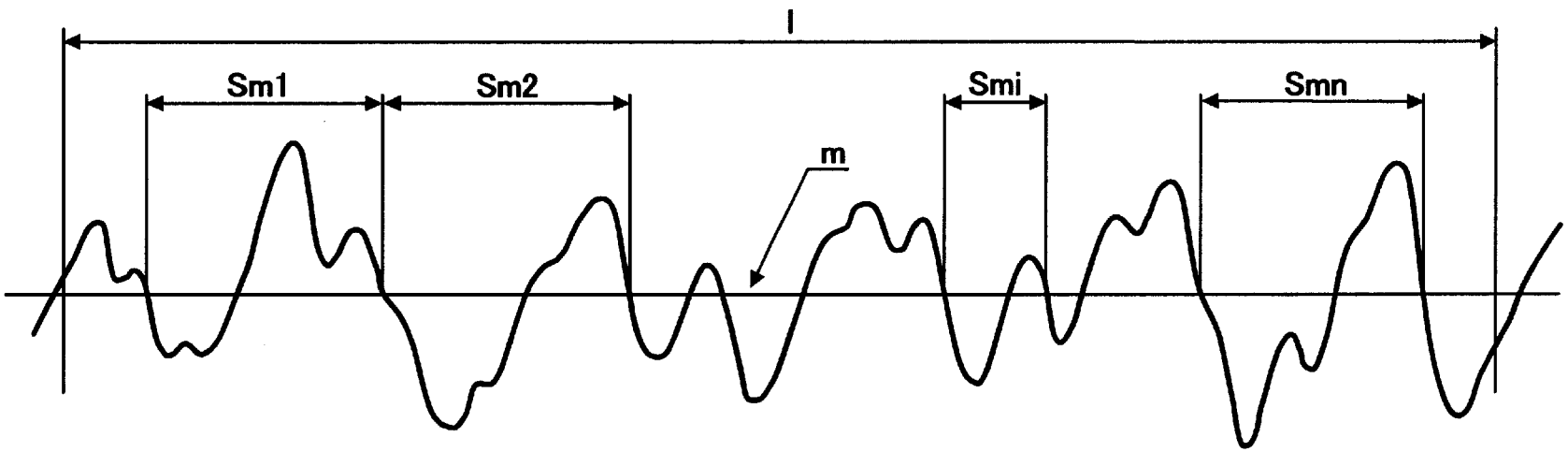

As shown in FIG. 12B, a portion having a measurement length 1 is sampled from a waviness curve. The sum of the width of a peak and the neighboring valley (i.e., Sm1, Sm2, . . . Si, . . . and Sn) is determined and the sum is divided by the number of the data. Namely, peak-to-peak length Sm is determined by the following equation:

$$Sm = \frac{1}{n}\sum_{i=1}^{n} Smi$$

The measurement length 1 is selected from the following lengths:

0.08 mm; 0.25 mm; 0.8 mm; 2.5 mm; 8 mm; and 25 mm.

In the present invention, measurements are performed under the following conditions:

Instrument: SURFCOM 570A manufactured by Tokyo Seimitsu Co., Ltd.

Cut-off value: 0.8 mm

Measurement length: 2.5 mm

Scanning speed: 0.3 mm/s

Radius of curvature of contact pin: 5 μm

When the ten-point mean roughness Rz of the surface of the recording material is less than 1.5 μm, a feeding problem such that the recording material cannot be fed or is not fed at a predetermined speed due to sticking of the recording material to the thermal printhead used tends to occur. In addition, the function of the recording material to clean dust adhered to the thermal printhead deteriorates.

Therefore the recording material needs to have a surface having a ten-point mean roughness not less than 1.5 μm. This is because the contact area between the surface of the recording material and a thermal printhead decreases, resulting in decrease of stress applied to the recording material when images are recorded and erased, and thereby the matching properties of the recording material for thermal printhead (i.e., the ability to be used with thermal printheads) can be improved. In addition, the dust scraped by the surface of the recording material from the surface of a thermal printhead can be fed out while being contained in recesses of the surface of the recording material. Thus, the recording material has good dust-cleaning ability.

The ten-point mean roughness of the surface of the recording material is more preferably not less than 2.0 μm. When the ten-point mean roughness is greater than 5.0 μm, a large air gap is formed between the surface of the recording material and the thermal printhead used and thereby the following problems tend to occur:

(1) the thermosensitivity (i.e., recording sensitivity) of the recording material deteriorates;

(2) the recording material has locally-uneven thermosensitivity;

(3) image erasing cannot be performed satisfactorily (i.e., a part of images remains even after an image erasure operation); and (4) image formation and erasure operation tends to be influenced by environmental conditions such as ambient air temperature.

Thus, in order to stably record and erase an image, the ten-point mean roughness (Rz) of the surface of the recording material is not greater than 5.0 μm, and more preferably not greater than 4.0 μm. In addition, in order to impart good image visibility to the recording material without causing light scattering on the surface thereof, the ten-point mean roughness thereof is preferably not greater than 3.5 μm, and more preferably not greater than 3.0 μm.

When the ratio Sm/Rz is greater than 120, the sticking problem and feeding problem occur due to deterioration of the head-matching properties of the recording material and in addition the dust-cleaning function thereof deteriorates. In order not to cause such problems, the ratio Sm/Rz needs to be not greater than 120. The ratio Sm/Rz means the height of the peak to the peak-to-peak length.

When the ratio Sm/Rz increases, the surface of the recording material unevenly contacts the thermal printhead used, resulting in application of excess stress to the peaks of the surface of the recording material, and thereby the surface is damaged. Thus, the matching properties of the recording material deteriorates. In addition, since heating energy is unevenly applied to the recording material, stable image formation and erasure cannot be performed.

The ratio Sm/Rz is preferably not greater than 100.

When the ratio is less than 30, the color tone of the recorded image (i.e., the image visibility) deteriorates due to light scattering on the surface of the recording material. Therefore, in order to impart good image visibility to the recording material, the ratio is not less than 30 and preferably not less than 50.

In the present invention, the film strength of the surface of the recording material is preferably grade F or harder when measured by JIS K5400-1990. The film strength of a surface is defined as the hardness of the hardest pencil among the pencils by which the surface of the film is broken at a rate less than 2/5.

Figure 13:
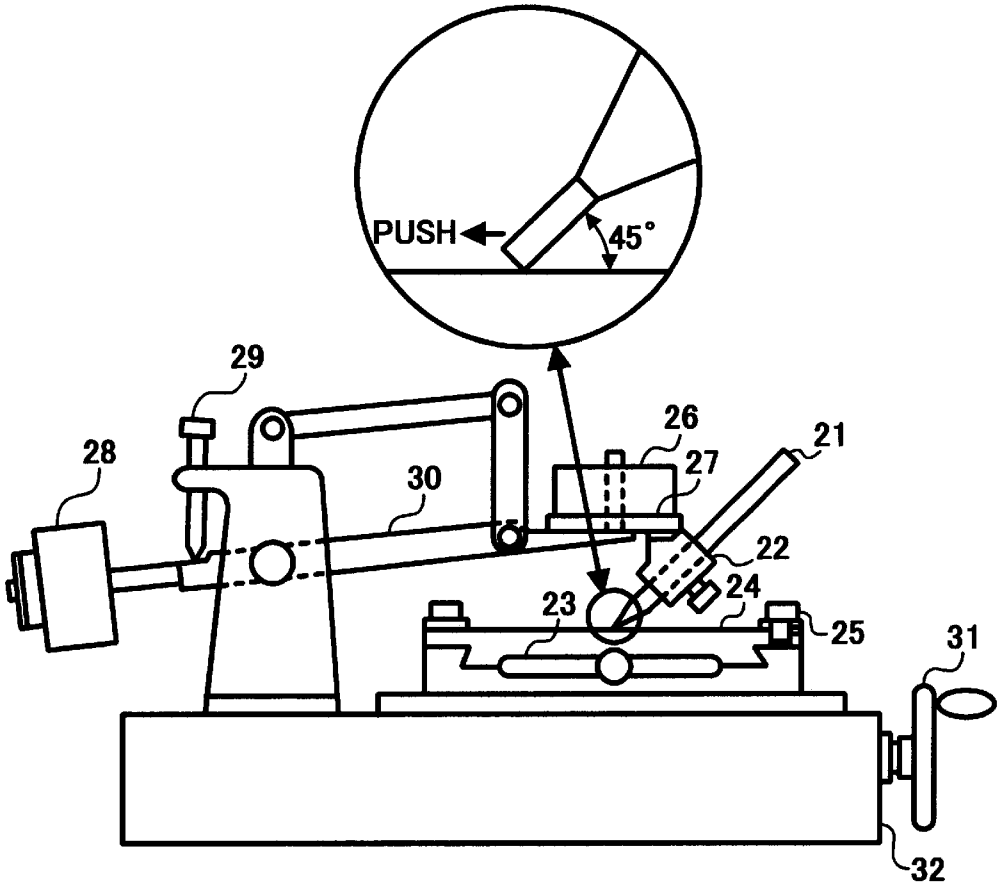
FIG. 13 is a schematic view illustrating an embodiment of the instrument used for measuring the film strength.

The method of measuring the film strength (i.e., JIS K5400-1990) will be explained referring to FIG. 13.

The strength of a coated film is determined using a method using a pencil scratching tester or a hand testing method. The method using a pencil scratching tester is explained referring to FIG. 13. In FIG. 13, numerals 21 and 22 denote a pencil and a pencil holder, respectively. Numerals 23, 24 and 25 denote a table on which a test piece is set, the test piece, and a fixer fixing the test piece on the table, respectively. Numerals 26, 27, 28, 29 and 30 denote a weight (1.00±0.05 kg), a weight table on which the weight is set, a balancing weight, a setscrew, and a shaft, respectively. Numerals 31 and 32 denote a handle by which the table on which the test piece is set is moved, and a bed of the instrument, respectively.

As the pencil, pencils which are prescribed in JIS S6006 are used. The hardness of the pencils used is from 9H (hardest) to 6B (softest). The wood portion of an edge of a pencil is removed to expose the lead by about 3 mm. The edge of the lead is abraded by an abrasive paper (#400) while the lead perpendicularly contacts the abrasive paper and describes circles to prepare a lead having a smooth surface and a sharp edge.

A test piece is subjected to the test at a time about one or more hours after the preparation of the film.

Test procedure is as follows:

(a) a test piece 24 is set on the table 23 such that the surface to be tested is upward;

(b) a pencil 21 is set with the pencil holder 22 such that the edge of the pencil 21 is on the vertical line passing the gravity center of the weight 26;

(c) the position of the balancing weight 28 is adjusted such that the load applied to the pencil 21 is 0, and then the shaft 30 is fixed by the setscrew 29 such that the pencil 21 does not contact the surface of the test piece 24;

(d) the weight 26 is set on the weight table 27, and then the setscrew 29 is loosened to contact the edge of the pencil 21 with the test piece 24 while a load of 1.00 kg is applied to the edge of the pencil;

(e) the handle 31 is rotated at a constant speed such that the test piece 24 is moved in the right hand direction by about 3 mm at a speed of 0.5 mm/sec;

(f) the measurements are performed 5 times while the scratching portion of the test piece is changed and the edge of the pencil is abraded; and (g) the operations (a) to (f) are repeated except that the pencil (hardness) is changed.

The film strength of a surface is defined as the hardness of the hardest pencil among the pencils by which the surface of the film is broken at a rate less than 2/5. Namely, for example, the test result is the following, the film strength of the sample is determined as H.

| | 3H | 2H | H | F | HB | B | 2B | 3B |
|---|---|---|---|---|---|---|---|---|
| Film breaking rate | 5/5 | 2/5 | 1/5 | 0/5 | 0/5 | 0/5 | 0/5 | 0/5 |

When the film strength of the surface of the recording material is grade HB (based on the pencil hardness) or softer, the surface tends to be abraded and damaged due to the stress applied when image formation and erasure operation is performed by a thermal printhead. In addition, the abraded portion of the surface tends to adhere to the thermal printhead, resulting in production of image omission. Therefore, the film strength of the surface of the recording material needs to be grade F or harder, and preferably grade H or harder.

Having generally described this invention, a further understanding can be obtained by reference to certain specific examples which are provided herein for purposes of illustration only and are not intended to be limiting. In the descriptions in the following examples, numbers represent weight ratios in parts, unless otherwise specified.

EXAMPLES

Formation of Recording Layer

A mixture of the following compounds was pulverized and dispersed in a paint shaker in order that the average particle diameter of the solid components in the liquid was from 0.1 to 1.5 μm, thus a liquid A was prepared:

| | |
|---|---|
| 2-anilino-3-methyl-6-dibutylaminofluoran (ODB from Hodogaya Chemical Co., Ltd., which serves as a coloring agent) | 4.5 |
| Color developer having the following formula | 15 |

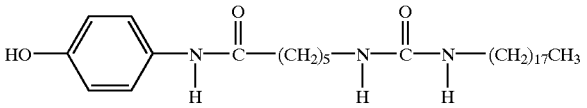

(RP-35 from Miyoshi Oil & Fat Co., Ltd.)

-continued

| | |
|---|---|
| Color developer having the following formula | 3 |

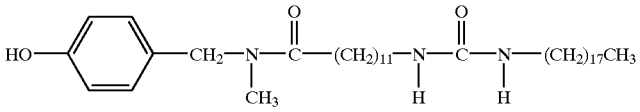

| | |
|---|---|
| (RA-171 from Miyoshi Oil & Fat Co., Ltd.) | |
| Color developer having the following formula | 3 |
| $C_{18}H_{37}NHCONHC_4H_9$ | |
| (RA-67 from Nippon Kasei Chemical Co., Ltd.) | |
| 50% acrylpolyol resin solution | 61 |
| (FR4754 from Mitsubishi Rayon Co., Ltd.) | |

Twenty (20) parts of ethyl acetate solution of an adduct type hexamethylene diisocyanate (CORONATE HL from Nippon Polyurethane Industry Co., Ltd., solid content of 75%) were mixed to the liquid A while being stirred to prepare a recording layer coating liquid.

The recording layer coating liquid was coated with a wire bar on a substrate of a white polyethylene terephthalate (PET) film having a thickness of 250 μm, dried at 120° C., and then heated at 100° C. for 10 minutes. In addition, the recording layer was heated at 60° C. for 48 hours to form a recording layer having a dry thickness of about 10 μm.

Formation of Intermediate Layer Coating Liquid

The following compounds were mixed to prepare an intermediate layer coating liquid.

| | |
|---|---|
| 50% acrylpolyol resin solution | 3 |
| (LR327 from Mitsubishi Rayon Co., Ltd.) | |
| 30% zinc oxide dispersion | 7 |
| (ZS303 from Sumitomo Cement Co., Ltd.) | |
| Adduct type hexamethylenediisocyanate | 1.5 |
| (CORONATE HL from Nippon Polyurethane Industry Co., Ltd., an ethyl acetate solution having a solid content of 75%) | |
| Methyl ethyl ketone | 7 |

Formation of Protective Layer Coating Liquid A

The following components were mixed while being stirred to prepare a protective layer coating liquid A.

| | |
|---|---|
| Dipentaerythritol hexaacrylate | 3 |
| (KAYARAD DPHA from Nippon Kayaku Co., Ltd.) | |
| Urethaneacrylate oligomer | 3 |
| (ARTRESIN UN-3320HA from Negami Kogyo K.K.) | |
| Acrylate of dipentaerythritol caprolactone | 3 |
| (KAYARAD DPCA-120 from Nippon Kayaku Co., Ltd.) | |
| Silica | 1 |
| (P-526 from Mizusawa Industrial Chemicals Ltd.) | |
| Photopolymerization initiator | 0.5 |
| (IRGACURE 184 from Nippon Ciba-Geigy) | |
| Isopropanol | 11 |

Formation of Protective Layer Coating Liquid B

The procedure for preparation of the protective layer coating liquid A was repeated except that the mixture was pulverized and dispersed using a paint shaker such that the silica had a particle diameter of about 3 μm.

Formation of Protective Layer Coating Liquid C

The procedure for preparation of the protective layer coating liquid A was repeated except that the mixture was pulverized and dispersed using a paint shaker such that the silica had a particle diameter of about 2 μm.

Formation of Protective Layer Coating Liquid D

The procedure for preparation of the protective layer coating liquid A was repeated except that the addition amount of the silica was changed to 0.5 parts and the mixture was pulverized and dispersed using a paint shaker such that the silica had a particle diameter of about 3 μm.

Formation of Protective Layer Coating Liquid E

The protective layer coating liquid B was mixed with 0.5 parts of a talc (LMS-300 from Fuji Talc Kogyo K.K.) and dispersed well to prepare a protective layer coating liquid E.

Formation of Protective Layer Coating Liquid F

The procedure for preparation of the protective layer coating liquid A was repeated except that the silica was replaced with a talc (LMS-300 from Fuji Talc Kogyo K.K.).

Formation of Protective Layer Coating Liquid G

The following components were mixed to prepare a protective layer coating liquid G.

| | |
|---|---|
| 75% urethane acrylate monomer | 10 |
| (C7-157 from Dainippon Ink And Chemicals, Inc.) | |
| Isopropanol | 5 |

Formation of Protective Layer Coating Liquid H

The following components were mixed to prepare a protective layer coating liquid H.

| | |
|---|---|
| 60% esteracrylate monomer | 10 |
| (Z-7010 from Japan Synthetic Rubber Co., Ltd.) | |
| Isopropanol | 2.5 |

Example 1

The intermediate layer coating liquid was coated on the above-prepared recording layer of the polyester film using a wire bar, and then dried at 90° C. for 1 minute. The intermediate layer was further heated at 60° C. for 48 hours. Thus, an intermediate layer having a thickness of about 1 μm was formed on the recording layer.

Then the protective layer coating liquid A was coated on the intermediate layer using a wire bar, and then heated to be dried. The protective layer was crosslinked using an ultraviolet lamp under a condition of 80 W/cm. Thus a protective layer having a thickness of about 2.5 μm was formed on the intermediate layer.

Thus, a reversible thermosensitive recording material of Example 1 was prepared.

Example 2

The procedure for preparation of the reversible thermosensitive recording material in Example 1 was repeated except that the protective layer coating liquid A was replaced with the protective layer coating liquid B.

Thus, a reversible thermosensitive recording material of Example 2 was prepared.

Example 3

The procedure for preparation of the reversible thermosensitive recording material in Example 1 was repeated except that the protective layer coating liquid A was replaced with the protective layer coating liquid D.

Thus, a reversible thermosensitive recording material of Example 3 was prepared.

Example 4

The procedure for preparation of the reversible thermosensitive recording material in Example 1 was repeated except that the protective layer coating liquid A was replaced with the protective layer coating liquid E.

Thus, a reversible thermosensitive recording material of Example 4 was prepared.

Example 5

The procedure for preparation of the reversible thermosensitive recording material in Example 1 was repeated except that the protective layer coating liquid A was replaced with the protective layer coating liquid F.

Thus, a reversible thermosensitive recording material of Example 5 was prepared.

Example 6

The intermediate layer coating liquid was coated on the above-prepared recording layer of the polyester film using a wire bar, and then dried at 90° C. for 1 minute (The heating treatment at 60° C. for 48 hours was not performed). Thus, an intermediate layer having a thickness of about 1 μm was formed on the recording layer.

Then the protective layer coating liquid B was coated on the intermediate layer using a wire bar, and then heated to be dried. The protective layer was crosslinked using an ultraviolet lamp under a condition of 80 W/cm. Thus a protective layer having a thickness of about 2.5 μm was formed on the intermediate layer.

Thus, a reversible thermosensitive recording material of Example 6 was prepared.

Example 7

An OP varnish (manufactured by THEINKTECH Co.) was coated on the protective layer of the recording material of Example 1 by a printing method using an RI tester. The OP layer was crosslinked using an ultraviolet lamp under a condition of 80 W/6 m. Thus, an OP layer having a thickness of about 0.8 μm was formed on the protective layer.

Thus, a reversible thermosensitive recording material of Example 7 was prepared.

Comparative Example 1

The procedure for preparation of the reversible thermosensitive recording material in Example 1 was repeated except that the protective layer coating liquid A was replaced with the protective layer coating liquid G.

Thus, a reversible thermosensitive recording material of Comparative Example 1 was prepared.

Comparative Example 2

The procedure for preparation of the reversible thermosensitive recording material in Example 1 was repeated except that the protective layer coating liquid A was replaced with the protective layer coating liquid H.

Thus, a reversible thermosensitive recording material of Comparative Example 2 was prepared.

Comparative Example 3

The procedure for preparation of the reversible thermosensitive recording material in Example 1 was repeated except that the protective layer coating liquid A was replaced with the protective layer coating liquid C.

Thus, a reversible thermosensitive recording material of Comparative Example 3 was prepared.

Each of the reversible thermosensitive recording materials of Examples 1 to 7 and Comparative Examples 1 to 3 was evaluated as follows:

(1) Head-Matching Property

An image was recorded in each recording material using a card printer R-3000 manufactured by Kyushu Matsushita Electric Co., Ltd. while applying a printing energy of 0.75 mJ/dot to the thermal printhead. Then the recording material was heated by the thermal printhead while applying a proper erasing energy to the thermal printhead such that the image was clearly erased visually. This image recording and erasing operation was repeated 10 times to evaluate whether the images had omissions or unclear portions and whether abnormal feeding noise was generated.

(2) Dust-Cleaning Ability

An image was recorded in a sheet of each recording material using a card printer R-3000 which was manufactured by Kyushu Matsushita Electric Co., Ltd. and which had a thermal printhead on which dust was intentionally adhered such that an image omission was formed in the resultant image. Then another sheet of the recording material was fed in the card printer to record an image therein. This image forming operation was repeated four times (five times in total) to evaluate whether the fifth image had an image omission. In this case, dust was adhered on the thermal printhead by repeatedly performing an operation of thumbing the surface of the thermal printhead followed by an image recording/erasing operation such that the resultant image had an image omission.

(3) Color Tone

The image density (OD1) of the image recorded in the recording material of Comparative Example 1, which had been subjected to an erasure operation once, was measured by a Macbeth reflection densitometer RD-914 manufactured by Macbeth Co. The color tone of the image recorded in the recording material was represented by the following equation:

$$\text{Color tone}=(ODX/OD1)\times 100(\%)$$

wherein ODX represents the image density of the image recorded in the recording material.

The color tone is preferably not less than 90% and more preferably not less than 95%.

The reason why the image of the recording material of Comparative Example 1 is considered as the standard is that the protective layer G of the recording material of Comparative Example 1 has a smooth and transparent surface like a glass and therefore the image formed in the recording layer can be seen as it is even though the protective layer is formed thereon. The image density of the image formed in the recording material of Comparative Example 1 (i.e., OD1) was 1.13.

(4) State of Surface of Recording Material After Repeated Image Formation/Erasure Operations The image formation/erasure operation performed in head-matching property evaluation method mentioned above in item (1) was repeated 50 times with respect to each recording material. Then the state of the surface of each recording material was visually observed to determine whether the surface was damaged (i.e., whether there were hurt and/or peeling on the surface) of the recording material. In addition, the final image was carefully observed to determine whether the image had an abnormal image.

The results are shown in Table 19.

TABLE 19

| | Rz | Sm/Rz | Film strength | Head matching | Dust cleaning ability | Color tone | | Surface state |
|---|---|---|---|---|---|---|---|---|
| Ex. 1 | 3.66 | 26.64 | H | ○ | ○ | 86 | Δ | ○ |
| Ex. 2 | 2.00 | 58.9 | H | ○ | ○ | 95 | ◎ | ○ |
| Ex. 3 | 2.44 | 110.6 | H | ○ | ○ | 99 | ◎ | ○ |
| Ex. 4 | 2.30 | 65.2 | H | ○ | ○ | 96 | ◎ | ○ |
| Ex. 5 | 2.18 | 90.3 | F | ○ | ○ | 99 | ◎ | ○ |
| Ex. 6 | 2.32 | 48.5 | B | ○ | ○ | 89 | Δ | Peeling (but no image density decrease) |
| Ex. 7 | 3.01 | 59.3 | F | ○ | ○ | 96 | ◎ | ○ |
| Comp. Ex. 1 | 0.52 | 835.3 | F | Omission, noise | X | — | — | Hurt |
| Comp. Ex. 2 | 1.47 | 164.9 | F | Noise | X | 99 | ◎ | Hurt |
| Comp. Ex. 3 | 1.27 | 278.2 | H | Omission, noise | X | 100 | ◎ | Hurt |

○ (head matching): image omissions and unclear images were not produced and feeding noise was not generated.
○ (dust cleaning ability): the fifth image had no abnormal image.
X (dust cleaning ability): the fifth image had an unclear portion.
◎ (color tone): not less than 95%
Δ (color tone): not less than 85% and less than 90%
○ (surface state): the image has no abnormal image while maintaining the image density and the surface had no hurt and peeling.

As can be understood from the above description, the reversible thermosensitive recording material having a surface having a ten-point mean roughness not less than 1.5 μm or a ratio Sm/Rz not greater than 120 has improved head-matching property and dust cleaning ability. In addition, when the ten-point mean roughness is from 1.5 to 3.0 μm, or the ratio Sm/Rz is from 50 to 120, the recording material has a further improved head-matching property and dust cleaning ability. In addition, the recording material can repeatedly produce good color tone images, i.e. can maintain good image visibility.

Further, when the film strength of the surface of the recording material is grade F or harder, and in addition the resin in each layer is crosslinked, the mechanical strength of the recording material can be improved, and thereby the recording material has good durability.

This document claims priority and contains subject matter related to Japanese Patent Application No. 2000-365841 filed on Nov. 30, 2000 incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by letters patent of the United States is:

1. A reversible thermosensitive recording material comprising:

1) a substrate;

2) a recording layer located overlying the substrate and comprising a crosslinked resin, an electron donating coloring agent and an electron accepting color developer; and 3) a protective layer located overlying the recording layer and comprising a filler and a crosslinked resin, wherein the recording layer in a non-colored state achieves a colored state when heated at a temperature not lower than an image forming temperature and then cooled at a cooling speed (a), and the recording layer in the colored state achieves a non-colored state when heated at a temperature lower than the image forming temperature and not lower than an image erasing temperature, or when heated at a temperature not lower than the image forming temperature and then cooled relatively slowly as compared to the cooling speed (a), and wherein the outermost surface on the recording layer side of the reversible thermosensitive recording material has at least one of a ten-point mean roughness (Rz) not less than 1.5 μm and a ratio Sm/Rz not greater than 120, wherein Sm represents an average peak-to-peak length of the surface of the recording material.

2. The reversible thermosensitive recording material according to claim 1, wherein the outermost surface on the recording layer side of the recording material has at least one of a ten-point mean roughness (Rz) of from 1.5 to 3.5 μm and a ratio Sm/Rz of from 30 to 120.

3. The reversible thermosensitive recording material according to claim 1, wherein the outermost surface on the recording layer side of the recording material has a film strength of grade F or harder when measured by JIS K5400-1990.

4. The reversible thermosensitive recording material according to claim 1, further comprising an intermediate layer located between the recording layer and the protective layer and comprising a crosslinked resin.

5. The reversible thermosensitive recording material according to claim 1, further comprising an over print layer overlying the protective layer and comprising a crosslinked resin and optionally a filler.

6. The reversible thermosensitive recording material according to claim 5, wherein the over print layer includes a filler, wherein the filler is an inorganic filler.

7. The reversible thermosensitive recording material according to claim 1, wherein the filler in the protective layer is an inorganic filler.

8. The reversible thermosensitive recording material according to claim 1, further comprising an information storage portion.

9. The reversible thermosensitive recording material according to claim 8, wherein the information storage portion comprises a device selected from the group consisting of magnetic recording device, IC memories and optical memories.

10. The reversible thermosensitive recording material according to claim 1, wherein the substrate comprises a laminated sheet in which a plurality of different sheets are laminated.

11. The reversible thermosensitive recording material according to claim 1, further comprising an adhesive layer on a backside of the substrate opposite that bearing the recording layer.

12. The reversible thermosensitive recording material according to claim 1, further comprising irreversible visible information.

13. The reversible thermosensitive recording material according to claim 1, wherein the reversible thermosensitive recording material is arranged on a device selected from the group consisting of point cards, prepaid cards, consultation tickets, admission tickets, commuter passes, discs, disc cartridges, cassette tapes and cassette cartridges.

14. A reversible thermal image recording/erasing method comprising:

heating the recording layer of the reversible thermosensitive recording material according to claim 1 at a temperature lower than the image forming temperature and not lower than the image erasing temperature such that the recording layer maintains or achieves a non-colored state; and imagewise heating the previously heated recording layer in a non-colored state at a temperature not lower than the image forming temperature and then cooling the recording layer at the cooling speed (a) to form a colored image in the recording layer.

15. The reversible thermal image recording/erasing method according to claim 14, wherein the heating and imagewise heating steps are performed using a thermal printhead.

16. The reversible thermal image recording/erasing method according to claim 14, wherein the heating step is performed using a heater selected from the group consisting of ceramic heaters, heat rollers, hot stamps and heat blocks.

17. A method for decoloring a reversible thermosensitive recording material comprising:

heating the recording layer of the reversible thermosensitive recording material according to claim 1 at a temperature lower than the image forming temperature and not lower than the image erasing temperature such that the recording layer maintains or achieves a non-colored state.

18. The reversible thermosensitive recording material according to claim 1, further comprising an intermediate layer interposed between the recording layer and the protecting layer.

19. The reversible thermosensitive recording material according to claim 1, further comprising an intermediate layer interposed between the recording layer and the protecting layer and an OP layer is overlaid on the protective layer.

20. The reversible thermosensitive recording material according to claim 1, further comprising an intermediate layer interposed between the recording layer and the protecting layer; wherein a print layer is formed on a surface portion of the protecting layer and an OP layer is overlaid on the protective layer and the print layer.

21. The reversible thermosensative recording material according to claim 1, wherein Rz is not less than 1.5 $\mu$m.

22. The reversible thermosensitive recording material according to claim 1, wherein Sm/Rz is not greater than 120.

23. The reversible thermosensitive recording material according to claim 1, wherein Rz is not less than 1.5 $\mu$m and Sm/Rz is not greater than 120.

* * * * *